US007032384B2

(12) United States Patent
Kumagai et al.

(10) Patent No.: US 7,032,384 B2
(45) Date of Patent: Apr. 25, 2006

(54) STEAM TURBINE PLANT

(75) Inventors: Kenji Kumagai, Kanagawa-ken (JP); Yukihiko Sawa, Kanagawa-ken (JP); Koichi Watanabe, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 106 days.

(21) Appl. No.: 10/796,014

(22) Filed: Mar. 10, 2004

(65) Prior Publication Data

US 2004/0177614 A1 Sep. 16, 2004

(30) Foreign Application Priority Data

Mar. 10, 2003 (JP) ..... 2003-063723

(51) Int. Cl.

| | |
|---|---|
| ***F01K 1/00*** | (2006.01) |
| ***F01K 7/34*** | (2006.01) |
| ***F01K 9/02*** | (2006.01) |
| ***F01K 25/08*** | (2006.01) |
| ***F22D 1/32*** | (2006.01) |
| ***F22D 5/18*** | (2006.01) |
| ***G21D 5/02*** | (2006.01) |

(52) U.S. Cl. ..... 60/670; 60/653; 60/676

(58) Field of Classification Search ..... 60/653, 60/670, 676, 677

See application file for complete search history.

(56) References Cited

U.S. PATENT DOCUMENTS

| | | | | |
|---|---|---|---|---|
| 3,878,273 | A * | 4/1975 | Anderson | 165/110 |
| 4,417,446 | A * | 11/1983 | Nakamoto et al. | 60/655 |
| 4,421,068 | A * | 12/1983 | Aral | 60/676 |
| 4,489,563 | A * | 12/1984 | Kalina | 60/673 |
| 5,860,279 | A * | 1/1999 | Bronicki et al. | 60/655 |
| 6,644,030 | B1 * | 11/2003 | Moss et al. | 60/657 |

* cited by examiner

*Primary Examiner*—Sheldon J Richter
(74) *Attorney, Agent, or Firm*—Foley & Lardner LLP

(57) ABSTRACT

Steam turbine plant includes a steam generator, a plurality of low pressure turbines being driven by steam from the steam generator, a plurality of steam condensers to condense the steam from the low pressure turbines into condensed water and a feedwater line which supplies the condensed water to the steam generator as feedwater. The feedwater line including a plurality of feedwater heating lines connected in parallel. A number of feedwater heating lines being less than a number of steam condensers. Each of the feedwater heating lines includes at least one low pressure feedwater heater provided in at least one of the steam condensers to heat the condensed water by steam bled from the low pressure turbines.

41 Claims, 16 Drawing Sheets

STEAM TURBINE PLANT

CROSS REFERENCE TO RERATED APPLICATION

This application is based upon and claims the benefit of priority from the prior Japanese Patent Application No. 2003-63723 filed on Mar. 10, 2003;

the entire contents of which are incorporated herein by reference.

FIELD OF THE INVENTION

The present invention relates to steam turbine plant.

More specifically, the invention relates to steam turbine plant for power generation, which is provided with a feedwater heater in a steam condenser.

DESCRIPTION OF THE BACKGROUND

A steam turbine plant includes steam generator, high pressure turbine, a plurality of low pressure turbines. The steam turbine plant further includes a plurality of steam condensers which condense steam from the plurality of low pressure turbines and a plurality of low pressure feedwater heaters which are provided within the steam condensers as the structural elements respectively. A feedwater heater which is provided within a steam condenser is also called as a neck heater, since the feedwater heater is installed at an upper (neck) portion of the steam condenser. The low pressure feedwater heaters constitute a plurality of feedwater heating lines which are arranged and connected in parallel. The steam turbine plant has a plurality of high pressure feedwater heaters which heat a feedwater from the low pressure feedwater heaters by steam bled from the high pressure turbine. Each of the steam condensers are connected to each of adjacent steam condensers by a connection shell. The steam condensers, the feedwater heating lines which are provided with the low pressure feedwater heaters arranged and connected in parallel, the high pressure feedwater heaters and steam generator are connected in series by feedwater line.

The low pressure feedwater heaters use bled steam from low pressure turbines as a heating source of the feedwater.

Generally, tiers of low pressure feedwater heaters arranged in series in the feedwater heating lines increase, the amount of heat exchanged in the low pressure feedwater heater also increases, which may contribute to high efficiency in view of thermal or plant efficiency. Moreover, when the low pressure feedwater heaters are installed inside of the steam condensers to save space of the steam turbine plant, it is desirable to reduce pressure drop of the steam discharged from the low pressure turbines and flowing around the low pressure feedwater heaters. For this reason, a neck heater type of structure is adopted for the steam condensers of conventional steam turbine plant. The neck heater type of structure is that the low pressure feedwater heaters are installed and arranged inside of the steam condensers at neck portions, which are a space above a portion where the steam discharged from the low pressure turbines condenses in the steam condensers.

Therefore, in conventional steam turbine plant, which includes n units of casings, n units of low pressure turbines and n units of steam condensers, constitute n pieces of the feedwater heating lines inserted in series to the feedwater line respectively. Each of the feedwater heating lines has a same number of the low pressure feedwater heaters, which are connected in series, inside of the steam condensers. The same numbers of the low pressure feedwater heaters are arranged in each of the steam condensers. Additionally, since each of the steam condensers are connected to the adjacent steam condenser by connection shell, differences of pressure distribution among the steam condensers are mitigated.

Nevertheless, since each of the low pressure feedwater heaters are connected with the bleeding lines, which extend from the casings of the low pressure turbines as a heating source, space of the neck portion of the steam condensers is relatively small. Especially, the bleeding lines have a large diameter for the low pressure feedwater heaters, which are provided at an upstream side of the feedwater heating lines, because the feedwater heaters at an upstream side of the feedwater heating lines employs the steam bled from a downstream side of the low pressure turbines as the heating source. This causes difficulty in planning such a steam turbine plant, especially in designing an arrangement of bleeding lines, feedwater heating lines or supports of these bleeding lines or low pressure feedwater heater at the neck portions. And it may result in necessity of further internal structure inside the steam condensers. This may cause necessity of enlarging space for the plant itself. And it may cause not only increase of costs but also pressure drop of the steam flowing inside of the steam condensers, which may effects reduction of the plant efficiency.

From a viewpoint of the feedwater, the feedwater line has feedwater heating lines whose number is the same as the steam condensers and which are arranged in parallel in conventional steam turbine plant. However, in order to avoid unbalance of the feedwater among the feedwater heating lines, it is desirable to provide less numbers of feedwater heating lines, which may contribute to increasing redundancies of controls of the steam turbine plant, especially for nuclear power plant.

SUMMARY OF THE INVENTION

Accordingly, an advantage of an aspect of the present invention is to provide a steam turbine plant which has less internal structure, e.g. The low pressure feedwater heaters, bleeding lines or so on, inside the steam condensers.

To achieve the above advantage, one aspect of the present invention is to provide a steam turbine plant that comprises a steam generator, a plurality of low pressure turbines being driven by steam from the steam generator, a plurality of steam condensers to condense the steam from the low pressure turbines into condensed water, a feedwater line which supplies the condensed water to the steam generator as feedwater, the feedwater line including a plurality of feedwater heating lines connected in parallel, a number of feedwater heating lines being less than a number of steam condensers, and a plurality of low pressure feedwater heaters, wherein each of the feedwater heating lines includes at least one low pressure feedwater heater provided in at least one of the steam condensers to heat the condensed water by steam bled from the low pressure turbines.

Another aspect of the present invention is to provide a steam turbine plant that comprises a steam generator, a plurality of low pressure turbines being driven by steam from the steam generator, a plurality of steam condensers to condense the steam from the low pressure turbines into condensed water, a feedwater line which supplies the condensed water to the steam generator as feedwater, the feedwater line including a plurality of first feedwater heating lines connected in parallel and a plurality of second feedwater heating lines connected in parallel and coupled to the downstream side of the first feedwater heating lines, a first number of first feedwater heating lines being different than a second number of second feedwater heating lines, and a plurality of low pressure feedwater heaters, wherein each of the first and second feedwater heating lines includes at least one low pressure feedwater heater provided in at least one of the steam condensers to heat the condensed water by steam bled from the low pressure turbines.

Another aspect of the present invention is to provide a steam turbine plant that comprises a steam generator, a plurality of low pressure turbines being driven by steam from the steam generator, a plurality of steam condensers to condense the steam from the low pressure turbines into condensed water, a feedwater line which supplies the condensed water to the steam generator as feedwater, the feedwater line including a plurality of feedwater heating lines connected in parallel and a plurality of low pressure feedwater heaters, wherein each of the feedwater heating lines includes at least one low pressure feedwater heater provided in at least one of the steam condensers to heat the condensed water by steam bled from the low pressure turbines, and wherein a first number of low pressure feedwater heaters provided in a first steam condenser is different than a second number of low pressure feedwater heaters provided in a second steam condenser.

In accordance with the aspect of the present invention, feedwater heating lines provided inside of the steam condensers are reduced so that space efficiency inside the steam condensers are improved and that the costs for a construction of the steam turbine plant are also reduced.

DETAILED DESCRIPTION OF THE INVENTION

First embodiment in accordance with the present invention will be explained with reference to FIG. 1 to FIG. 14.

Figure 1:
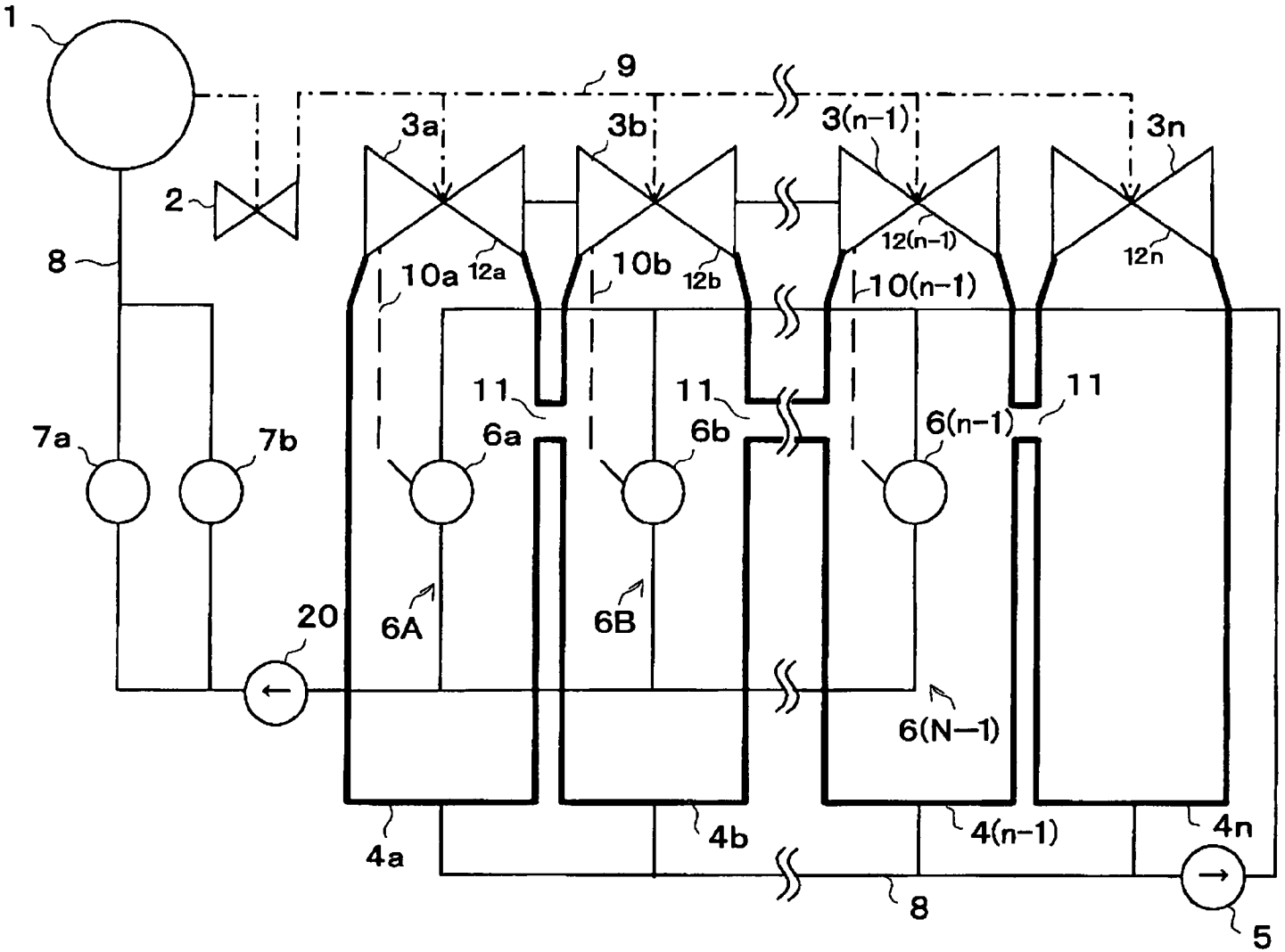
FIG. 1 is a schematic diagram of a first embodiment of a steam turbine plant in accordance with the present invention, which includes n units of pressure turbines, casings, and steam condensers.

FIG. 1 is a schematic diagram of a steam turbine plant in accordance with the present invention, which includes n units of low pressure turbines, n units of casings, and n units of steam condensers.

Steam generator 1, which is connected with a heating source (not shown), for example nuclear reactor or boiler, generates steam. The steam passes through high pressure turbine 2 and steam line 9, then lead to a plurality of casings 12*a*, 12*b*, 12*c*, . . . and 12*n* of low pressure turbines 3*a*, 3*b*, 3*c*, . . . and 3*n*. Generally, the number of low pressure turbines 3*a*, 3*b*, 3*c*, . . . and 3*n* are more than or equal to three (3). Each of low pressure turbines 3*a*, 3*b*, 3*c*, . . . and 3*n* are installed in casings 12*a*, 12*b*, 12*c*, . . . and 12*n*, whose number is also the same as the number of low pressure turbines 3*a*, 3*b*, 3*c*, . . . and 3*n*. The steam led to each of the casings 12*a*, 12*b*, 12*c*, . . . and 12*n* drives each of low pressure turbines 3*a*, 3*b*, 3*c*, . . . and 3*n*. The steam is then discharged from low pressure turbines 3*a*, 3*b*, 3*c*, . . . and 3*n* to each of steam condensers 4*a*, 4*b*, 4*c*, . . . and 4*n* as discharged steam. Each of steam condensers 4*a*, 4*b*, 4*c*, . . . and 4*n* are placed beneath each of low pressure turbines 3*a*, 3*b*, 3*c*, . . . and 3*n* and are connected with each of the casings 12*a*, 12*b*, 12*c*, . . . and 12*n*. Each of the steam condensers 4*a*, 4*b*, 4*c*, . . . and 4*n* are connected to each of adjacent steam condensers 4*a*, 4*b*, 4*c*, . . . and 4*n* by a connection shell 11. In steam condensers 4*a*, 4*b*, 4*c*, . . . and 4*n*, the discharged steam is cooled down and condenses into water as a condensed water (condensate). The condensed water (condensate) is gathered and led to feedwater line 8. In feedwater line 8, condensate pump 5 (pressurizer) give pressure to the condensed water (condensate) as a feedwater. The feedwater is led to low pressure feedwater heaters 6*a*, 6*b*, 6*c*, . . . and 6(*n*-1) and is heated up. The feedwater, after heated up in low pressure feedwater heaters 6*a*, 6*b*, 6*c*, . . . and 6(*n*-1), is further pumped up by feedwater pump 20 (pressurizer) as a high pressure feedwater pump. The feedwater pumped up to high pressure by feedwater pump 20 (pressurizer) then led to high pressure feedwater heaters 7*a* and 7*b* in feedwater line 8. In high pressure feedwater heaters 7*a* and 7*b*, the feedwater is further heated up and then supply to steam generator 1 from feedwater line 8. In this manner, the steam turbine plant constitutes closed-loop as a Rankine Cycle.

Bled steam for low pressure feedwater heaters 6*a*, 6*b*, 6*c*, . . . and 6(*n*-1) is taken out from the middle of low pressure turbines 3*a*, 3*b*, 3*c*, . . . and 3*n*. The bled steam is led to bleeding lines 10*a*, 10*b*, 10*c*, . . . and 10(*n*-1) as bleeding steam lines from an opening provided in the casings 12*a*, 12*b*, 12*c*, . . . and 12(*n*-1) of low pressure turbines 3*a*, 3*b*, 3*c*, . . . and 3(*n*-1). Each of bleeding lines 10*a*, 10*b*, 10*c*, . . . and 10(*n*-1) are connected to each of feedwater heaters 6*a*, 6*b*, 6*c*, . . . and 6(*n*-1) High pressure feedwater heaters 7*a* and 7*b* are employ bled steam from high pressure turbine 2 or from steam line 9 as a heating source (not shown).

Low pressure feedwater heaters 6*a*, 6*b*, 6*c*, . . . and 6(*n*-1) are shell and tube type heat exchangers. The shell and tube type heat exchangers are constituted by a shell and a plurality of tubes arranged inside the shell. Feedwater is passed through the tubes and exchanging heat, while the steam for heating is led to a shell side of the shell and tube type heat exchanger.

Low pressure feedwater heaters 6*a*, 6*b*, 6*c*, . . . and 6(*n*-1) are installed inside a neck portion of steam condensers 4*a*, 4*b*, 4*c*, . . . and 4(*n*-1) to improve a space efficiency. The neck portion is a space above a portion where the steam that passed through low pressure turbines 3*a*, 3*b*, 3*c*, . . . and 3*n* condenses in each of steam condensers 4*a*, 4*b*, 4*c*, . . . and 4*n*. Thus, low pressure feedwater heaters 6*a*, 6*b*, 6*c*, . . . and 6(*n*-1) are arranged inside the space of steam condensers 4*a*, 4*b*, 4*c*, . . . and 4(*n*-1).

Steam condensers 4*a*, 4*b*, 4*c*, and 4*n* are closely arranged each other. (n-1) units of low pressure feedwater heaters 6*a*, 6*b*, 6*c*, . . . and 6(*n*-1) are provided inside steam condensers 4*a*, 4*b*, 4*c*, . . . and 4(*n*-1). Feedwater line 8 includes a plurality of feedwater heating lines 6A, 6B, 6C, . . . and 6(N-1). Each of the feedwater heating lines 6A, 6B, 6C, . . . and 6(N-1) has one of low pressure feedwater heaters 6*a*, 6*b*, 6*c*, . . . 6(*n*-1) respectively. Low pressure feedwater heaters 6*a*, 6*b*, 6*c*, . . . 6(*n*-1) are arranged and connected in parallel inside of steam condensers 4*a*, 4*b*, 4*c*, . . . and 4*n*. Feedwater heating lines 6A, 6B, 6C, . . . and 6(N-1) are provided between condensate pump 5 (pressurizer) and high pressure feedwater pump 20 (pressurizer) in feedwater line 8. Feedwater lines 8 includes feed water heating lines 6A, 6B, 6C, . . . and 6(N-1) as a constituent elements. Feedwater heating lines 6A, 6B, 6C and 6N are seriesly inserted in feedwater line 8 as a whole.

Each of feedwater heating lines 6A, 6B, 6C, . . . and 6(N-1) may have a plurality of low pressure feedwater heaters arranged and connected in series. In this case, all of steam condensers 4*a*, 4*b*, 4*c*, . . . and 4*n* may have at least one of low pressure feedwater heaters, and the number of the low pressure feedwater heaters may be greater than the number of steam condensers 4*a*, 4*b*, 4*c*, . . . and 4*n*. There is a less number of the feedwater heating lines, which are connected in parallel and inserted in series in feedwater line 8, than the number of steam condensers 4*a*, 4*b*, 4*c*, . . . and 4*n*. The number of the feedwater heating lines may be one (1) or more, but is less than the number of steam condensers 4*a*, 4*b*, 4*c*, . . . and 4*n*. Bleeding steam lines 10*a*, 10*b*, 10*c*, and 10(*n*-1) may be connected to any of casings 12*a*, 12*b*, 12*c*, and 12*n* of low pressure turbines 3*a*, 3*b*, 3*c*, . . . and 3*n*.

According to this embodiment, the number of the low pressure feedwater heaters disposed inside of steam condenser 4*a*, 4*b*, 4*c*, . . . and 4*n* are lessened compared with a conventional steam turbine plant. In order to keep the amount of heat exchanged in the low pressure feedwater heaters at a preferable level, each of low pressure feedwater heaters 6*a*, 6*b*, 6*c*, . . . and 6(*n*-1) may be enlarged in size to increase the amount of heat. However, internal structures, such as bleeding lines, of steam condensers 4*a*, 4*b*, 4*c*, . . . and 4*n* maybe lessened to improve pressure drop of the steam inside steam condensers 4*a*, 4*b*, 4*c*, . . . and 4*n*. And the size of steam condensers 4*a*, 4*b*, 4*c*, . . . and 4*n* may be reduced.

Some detailed configurations of the first embodiment having three (3) units of the low pressure turbines, the casings and the steam condensers are explained below with reference of FIGS. 2 to 14.

FIGS. 2 to 7 are schematic diagrams of a detailed configuration of the first embodiment of a steam turbine plant in accordance with the present invention, including three (3) units of low pressure turbines, three (3) units of casings, and three (3) units of steam condensers.

Figure 2:
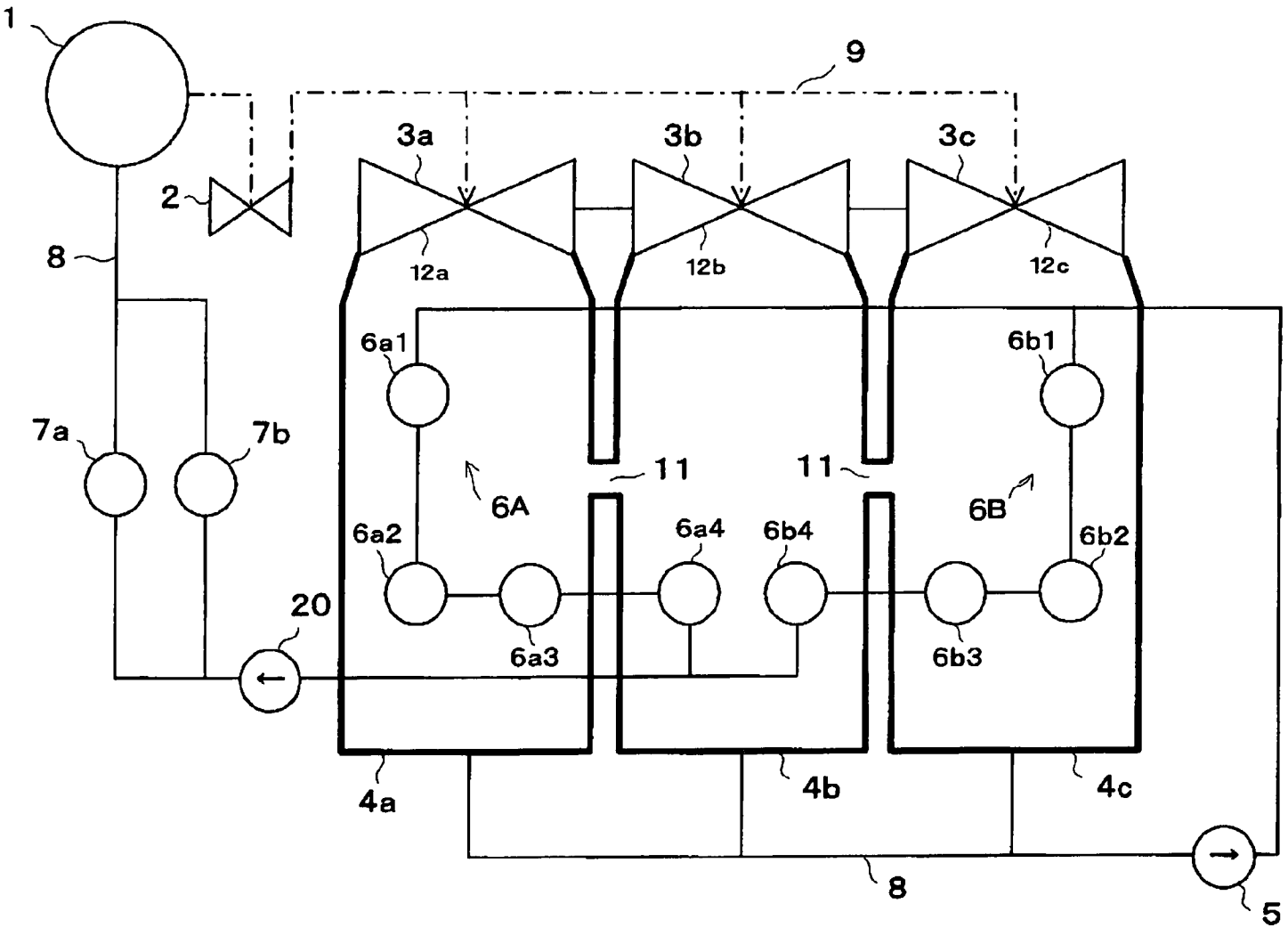
FIGS. 2 to 6 are schematic diagrams of a first embodiment of a steam turbine plant in accordance with the present invention, which includes three (3) units of low pressure turbines, casings, and steam condensers.

FIG. 2 especially features an arrangement of feedwater heaters inside steam condensers. The number of the casings 12*a*, 12*b* and 12*c* of steam turbine 3*a*, 3*b* and 3*c* is three (3). Each of the casings 12*a*, 12*b* and 12*c* is connected with each of steam condensers 4*a*, 4*b* and 4*c* respectively.

As described in FIG. 2, feedwater line 8 is divided into two (2) parallel feedwater heating lines 6A and 6B at a downstream side of condensate pump 5 (pressurizer) in feedwater line 8. Low pressure feedwater heaters 6*a*1 to 6*a*4 are connected in series in feedwater heating line 6A, while low pressure feedwater heaters 6*b*1 to 6*b*4 are connected in series in feedwater heating line 6B. Low pressure feedwater heaters 6*a*1 to 6*a*4 and 6*b*1 to 6*b*4 are neck heaters, which are disposed inside of steam condensers 4*a*, 4*b* and 4*c*. Each four (4) of low pressure feedwater heaters 6*a*1 to 6*a*4 and 6*b*1 to 6*b*4, which are connected in series in either of feedwater heating lines 6A or 6B, are dispersed in two (2) of steam condensers 4*a*, 4*b* and 4*c*.

Steam condenser 4*a* accommodates low pressure feedwater heaters 6*a*1, 6*a*2 and 6*a*3 as neck heaters. Steam condenser 4*b* accommodates low pressure feedwater heaters 6*a*4 and 6*b*4 as neck heaters. Steam condenser 4*c* accommodates low pressure feedwater heaters 6*b*1, 6*b*2 and 6*b*3 as neck heaters. Feedwater heating lines 6A and 6*b* are merged into one at an upstream side of high pressure feedwater pump 20 in feedwater line 8.

The feedwater, from steam condensers 4*a*, 4*b* and 4*c*, is divided into two flows and is led to each of feedwater heating lines 6A and 6B. In feedwater heating line 6A, The temperature of the feedwater rises as the feedwater flow through low pressure feedwater heaters 6*a*1, 6*a*2, 6*a*3 and 6*a*4 in this order. In the same manner, the temperature of the feedwater rises as the feedwater flows through low pressure feedwater heaters 6*b*1, 6*b*2, 6*b*3 and 6*b*4 in this order in feedwater heating line 6B. As a heating source, steam bled from low pressure steam turbine 3*a*, 3*b* and 3*c* are introduced to low pressure feedwater heater 6*a*1 to 6*a*4 and 6*b*1 to 6*b*4. Connections of bleeding lines are explained with reference to FIGS. 3 to 7.

Figure 3:
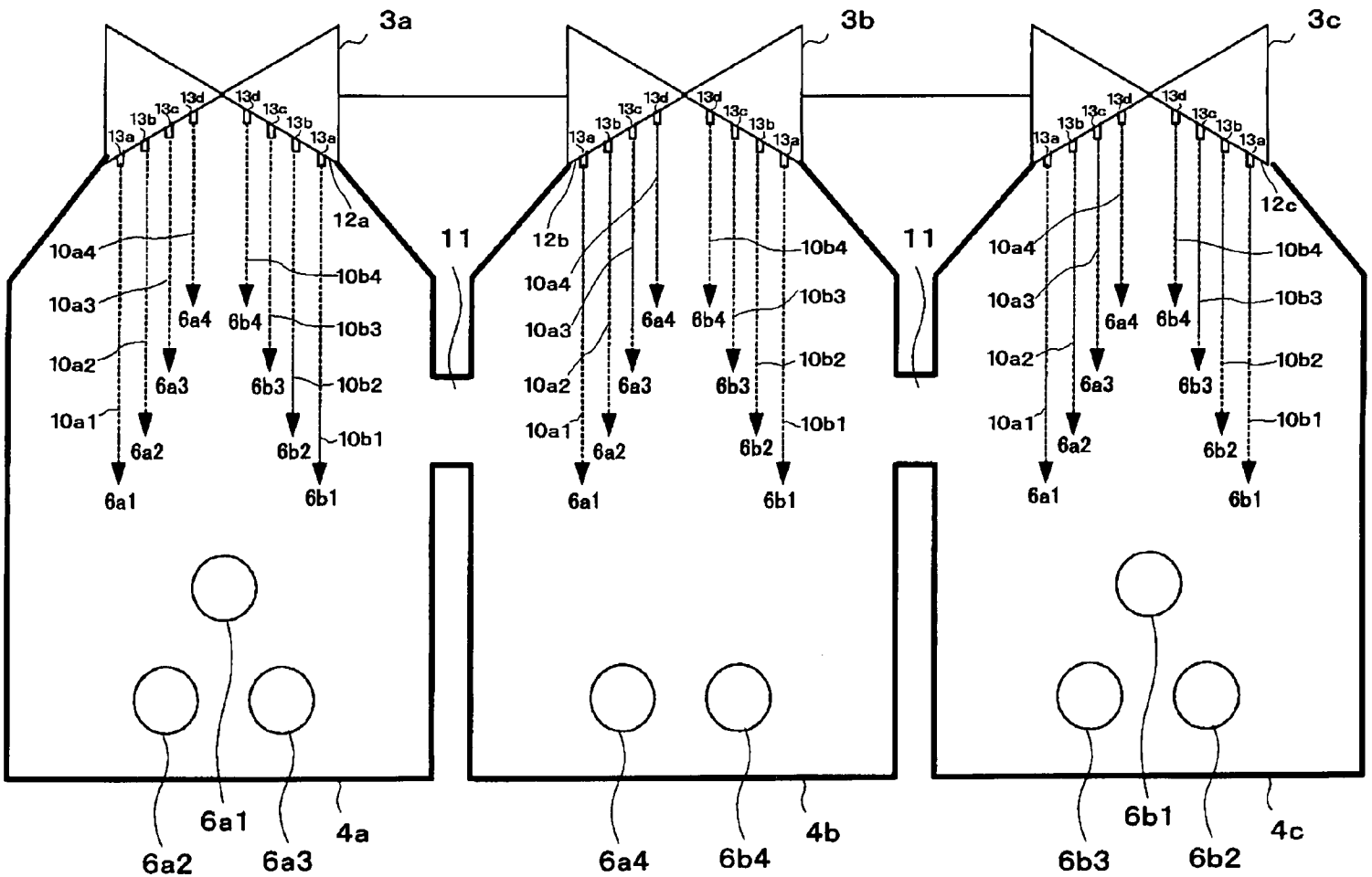

FIG. 3 is a schematic diagram of a detailed configuration of the first embodiment shown in FIG. 2, especially featuring an arrangement of bleeding lines.

Since four (4) low pressure feedwater heaters 6*a*1 to 6*a*4 and 6*b*1 to 6*b*4 are connected in series respectively in each of feedwater heating lines 6A and 6B, four (4) different conditions of bled steam is used for each of tiers of low pressure feedwater heaters 6*a*1 and 6*b*1, 6*a*2 and 6*b*2, 6*a*3 and 6*b*3, 6*a*4 and 6*b*4 as the heating source. As mentioned above, bled steam, as the heating source, is taken out (bled) from low pressure turbines 3*a*, 3*b* and 3*c*. As shown in FIG. 3, each of casings 12*a*, 12*b* and 12*c* are provided with four (4) openings 13*a*, 13*b*, 13*c* and 13*d* so as to take out steam of four (4) different conditions from low pressure turbines 3*a*, 3*b* and 3*c* as bled steam. Since the temperature and the pressure of steam decreases as the steam flows inside of low pressure turbines 3*a*, 3*b* and 3*c* from an upstream side to a downstream side, the condition of the steam, which is taken out (bled) from low pressure turbines 3*a*, 3*b* and 3*c*, may easily determined by a position of openings 13*a*, 13*b*, 13*c* and 13*d* in casings 12*a*, 12*b* and 12*c*. In FIG. 3, each of openings 13*a*, 13*b*, 13*c* and 13*d* exists substantially in a same position for each of casings 12*a*, 12*b* and 12*c*.

Bleeding lines 10*a*1 to 10*a*4 and 10*b*1 to 10*b*4 are connected to low pressure feedwater heater 6*a*1 to 6*a*4 and 6*b*1 to 6*b*4 respectively. More precisely, openings 13*a* are connected to low pressure feedwater heaters 6*a*1 and 6*b*1 by bleeding lines 10*a*1, openings 13*b* are connected to low pressure feedwater heaters 6*a*2 and 6*b*2 by bleeding lines 10*a*2, openings 13*c* are connected to low pressure feedwater heaters 6*a*3 and 6*b*3 by bleeding lines 10*a*3, and openings 13*d* are connected to low pressure feedwater heaters 6*a*4 and 6*b*4 by bleeding lines 10*a*4. Bleeding lines 10*a*1 to 10*a*4 and 10*b*1 to 10*b*4 may pass through connection shells 11. The connections of bleeding lines 10*a*1 to 10*a*4 may be determined suitably provided that the conditions, such as the temperature or the pressure, of bled steam supplied to each of low pressure feedwater heater 6*a*1 to 6*a*4 and 6*b*1 to 6*b*4 are determined appropriately.

Figure 4:
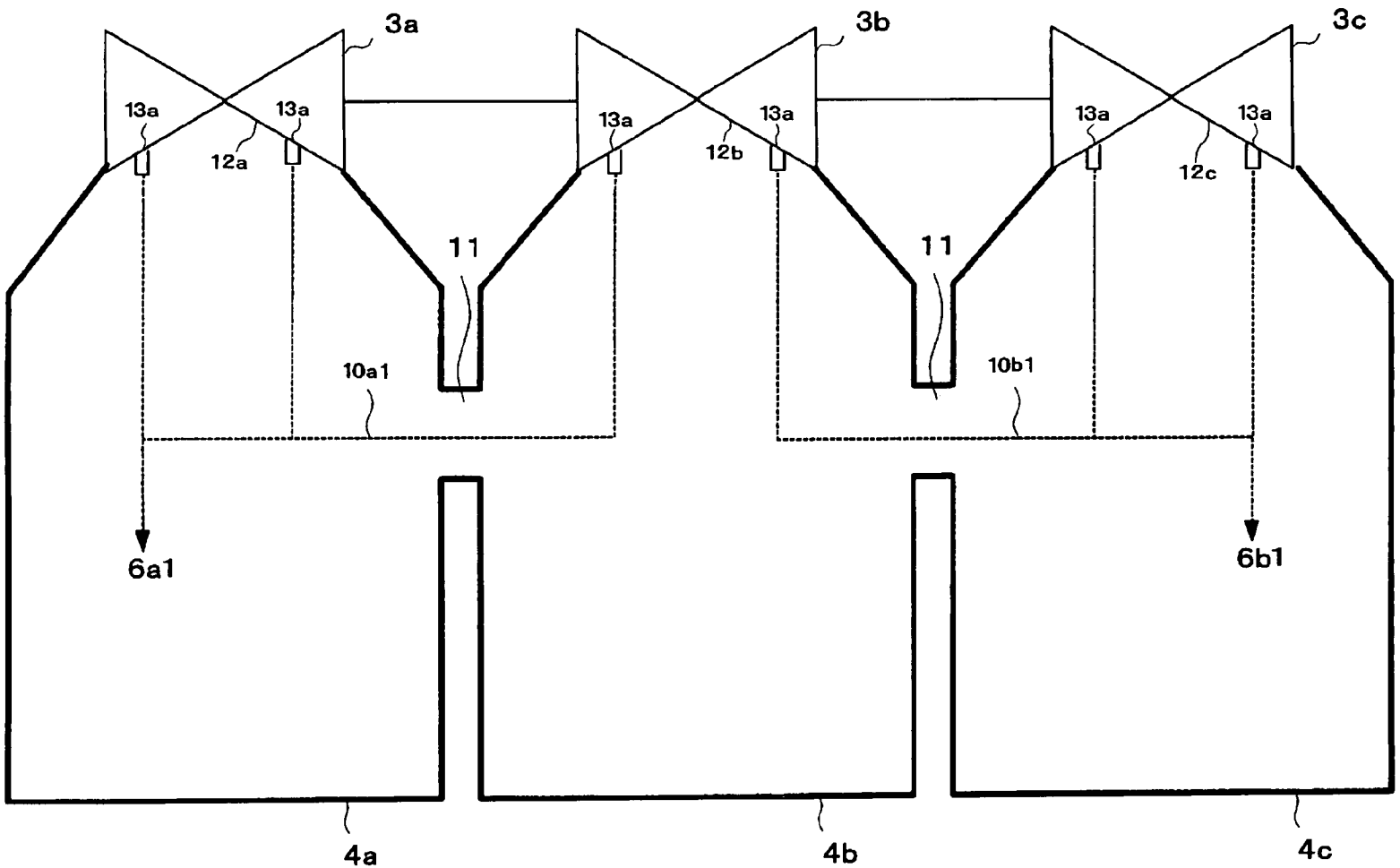

FIG. 4 shows an arrangement of the bleeding lines, especially featuring bleeding lines which supply bled steam to low pressure feedwater heaters 6a1 and 6b1 shown in FIGS. 2 and 3. In FIG. 4, only a part of openings 13a and bleeding lines 6a1 and 6b1 are shown, however, other bleeding openings are arranged as shown in FIG. 3.

As shown in FIG. 4, since each of low pressure turbines 3a, 3b and 3c has symmetrical configuration, two (2) openings 13a are symmetrically disposed in each of casings 12a, 12b and 12c. So, six (6) openings 13a are disposed in casings 12a, 12b and 12c. As described above, two (2) low pressure feedwater heaters 6a1 and 6b1, one of which is disposed inside of steam condenser 4a and the other is disposed inside of steam condenser 4c, use bled steam from openings 13a as the heating source. Therefore, bleeding lines 10a1 and 10b1 are connected so that the bled steam from each three (3) of openings 13a is merged and is led to each of low pressure feedwater heaters 6a1 and 6b1. In FIG. 4, since low pressure feedwater heater 6a1 is disposed inside of steam condenser 4a, the bled steam from two (2) openings 13a inside of steam condenser 4a and from one (1) opening 13a, which is close to steam condenser 4a, inside of steam condenser 4b, is led to low pressure feedwater heater 6a1 by bleeding line 10a1. The bled steam from other three openings 13a, which are relatively close to low pressure feedwater heater 6b1, is led to low pressure feedwater heater 6b1 by bleeding line 10b2. Other bleeding lines are arranged and connected in the same manner, though these are not shown in FIG. 4.

Figure 5:
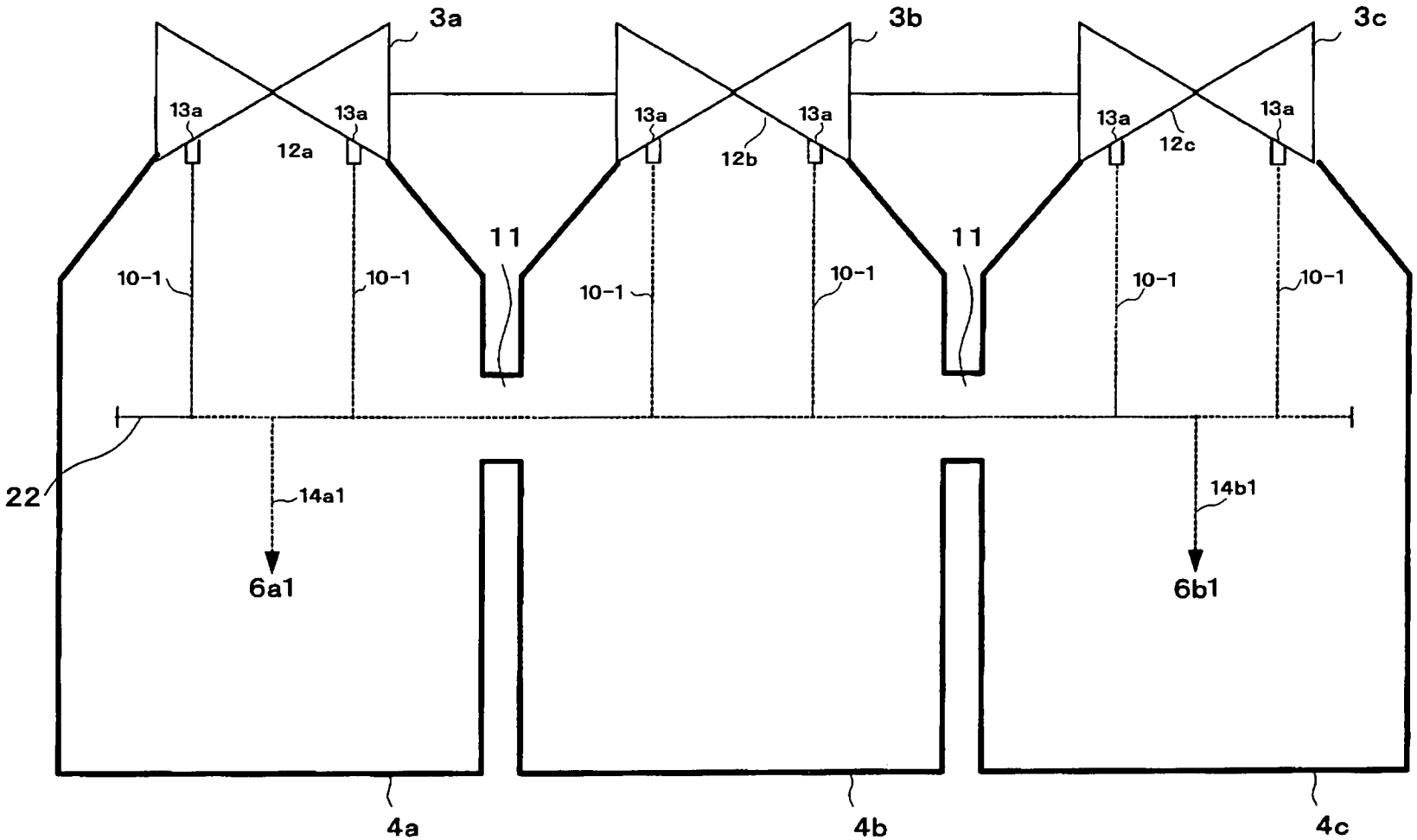

FIG. 5 shows another arrangement of the bleeding lines, especially featuring bleeding lines which supply bled steam to low pressure feedwater heaters 6a1 and 6b1 shown in FIGS. 2 and 3. In FIG. 5, though only a part of openings 13a and bleeding lines 6a1 and 6b1 are shown like FIG. 4, Other bleeding openings are arranged as shown in FIG. 3.

In FIG. 5, bleeding steam header 22 is disposed inside of steam condensers 4a, 4b and 4c. Bleeding steam header 22 is connected to each of openings 13a by bleeding lines 10-1. Bleeding steam supply lines 14a1 and 14b1 are connected between bleeding steam header 22 and low pressure feedwater heaters 6a1 and 6b1 respectively. Thus, the bled steam, which is taken out from low pressure turbine 3a, 3b and 3c, is gathered inside of bleeding steam header 22, and then is led to each of low pressure feedwater heaters 6a1 and 6b1 as the heating source. In other word, bleeding steam header 22 is used as a buffer of the bled steam taken out from low pressure turbines 3a, 3b and 3c. Bleeding steam header 22 may be disposed outside of steam condensers 4a, 4b and 4c. Though, not shown in FIG. 5, other bleeding steam headers for the bled steam, which is to be led the bled steam to other tiers of the low pressure feedwater heaters, may be disposed.

Figure 6:
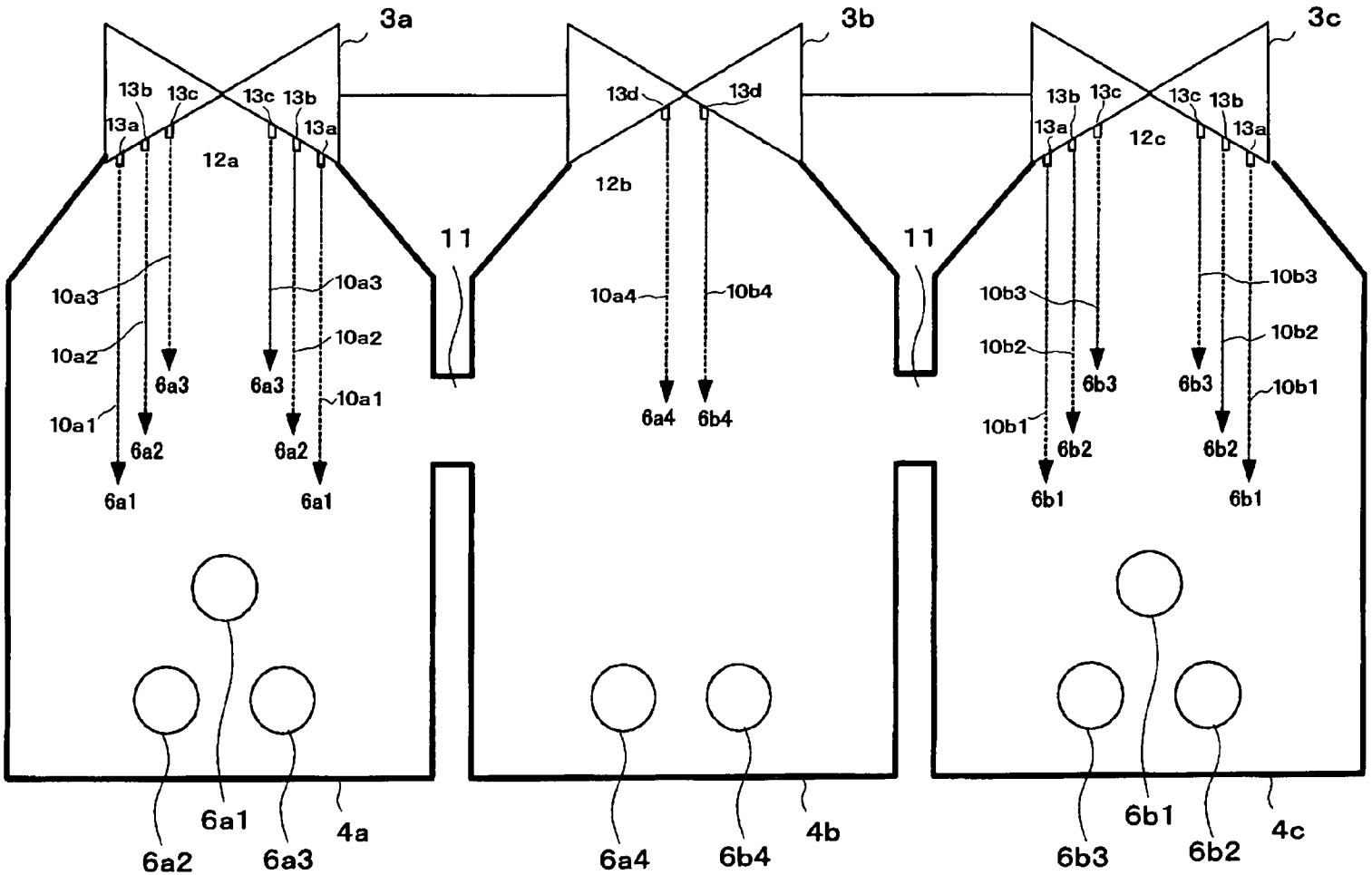

FIG. 6 is a schematic diagram of another detailed configuration of the first embodiment shown in FIG. 2, especially featuring an arrangement of bleeding lines.

As shown in FIG. 6, two (2) sets of openings 13a, 13b, 13c or 13d, each of which bleed different conditions of steam from low pressure turbine 3a, 3c and 3c, are symmetrically disposed in casings 12a, 12b and 12c. However, openings 13a, 13b and 13c are disposed in casings 12a and 12c, while openings 13d are disposed in casing 12b. Low pressure feedwater heaters 6a1, 6a2 and 6a3 are installed in steam condenser 4a, which is connected with casing 12a. So, openings 13a, 13b and 13c disposed in casing 12a are connected with low pressure feedwater heaters 6a1, 6a2 and 6a3 by bleeding lines 10a1, 10a2 and 10a3. In the same manner, openings 13d disposed in casing 12b are connected with low pressure feedwater heaters 6a4 and 6b4 by bleeding lines 10a4 and 10b4. Openings 13a, 13b and 13c disposed in casing 12c are connected with low pressure feedwater heater 6b1, 6b2 and 6b3 by bleeding lines 10b1, 10b2 and 10b3. In other words, bleeding lines 10a1, 10a2 and 10a3 are disposed inside of steam condenser 4a. Bleeding lines 10a4 and 10b4 are disposed inside of steam condenser 4b. Bleeding lines 10b1, 10b2 and 10b3 are disposed inside of steam condenser 4c. Thus, each of bleeding lines 10a1 to 10a4 and 10b1 to 10b4 are disposed inside of the steam condenser which is connected with the casings, to which each of respective bleeding lines 10a1 to 10a4 and 10b1 to 10b4 are connected. This configuration enables to avoid leading the bleeding lines around steam condensers 4a, 4b and 4c.

Figure 7:
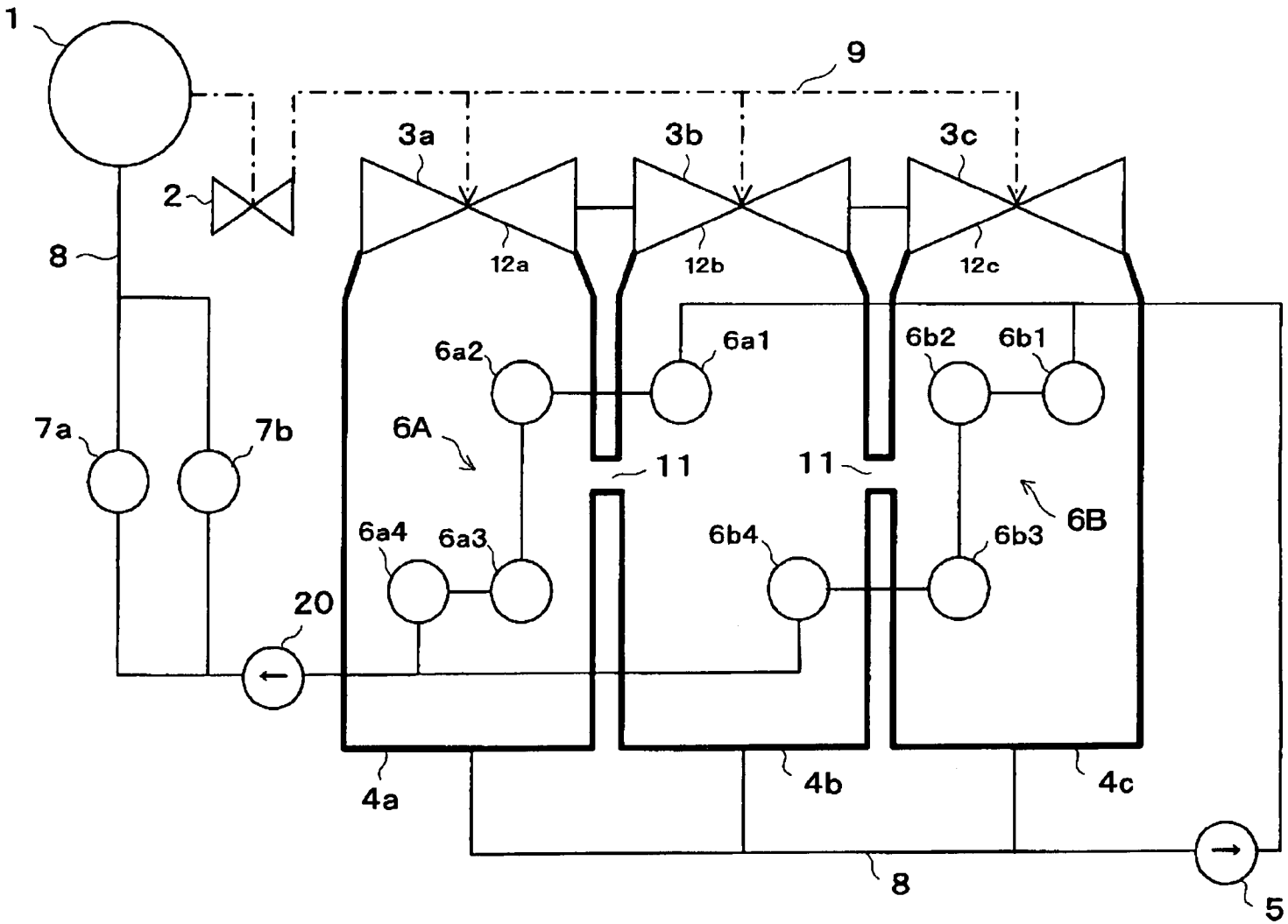
FIGS. 7 to 13 are schematic diagrams of a first embodiment of a steam turbine plant in accordance with the present invention, which includes three (3) units of low pressure turbines, casings, and steam condensers, especially showing an arrangement of bleeding lines inside steam condensers.

FIG. 7 is a schematic diagram of modified configuration of the first embodiment of a steam turbine plant in accordance with the present invention, including three (3) units of low pressure turbines, casings, and steam condensers, which especially shows an arrangement of feedwater heaters inside of steam condensers.

The number of the casings of steam turbine 3a, 3b and 3c is also three (3). Each of the casings is connected with each of steam condensers 4a, 4b and 4c respectively. As is the same manner with FIG. 2, feedwater line 8 is divided into two (2) feedwater heating lines 6A and 6B connected in parallel at a downstream side of condensate pump 5 (pressurizer) in feedwater line 8. Low pressure feedwater heaters 6a1 to 6a4 are connected in series in feedwater heating line 6A, while low pressure feedwater heaters 6b1 to 6b4 are connected in series in feedwater heating line 6B. Low pressure feedwater heaters 6a1 to 6a4 and 6b1 to 6b4 are neck heaters, which are disposed inside of steam condensers 4a, 4b and 4c. Each four (4) of low pressure feedwater heaters 6a1 to 6a4 and 6b1 to 6b4, which are connected in series in either of feedwater heating lines 6A or 6B, are dispersed in two (2) of steam condensers 4a, 4b and 4c.

Steam condenser 4a accommodates low pressure feedwater heaters 6a2, 6a3 and 6a4 as neck heaters. Steam condenser 4b accommodates low pressure feedwater heaters 6a1 and 6b4 as neck heaters. Steam condenser 4c accommodates low pressure feedwater heaters 6b1, 6b2 and 6b3 as neck heaters. Feedwater heating lines 6A and 6b are merged into one line at an upstream side of high pressure feedwater pump 20 in feedwater line 8.

According to this configuration, total amount of the low pressure feedwater heaters may be also lessened compared to the conventional steam turbine plant. It may contribute to improve pressure drop inside the steam condensers 4a, 4b and 4c, to reduce internal constructions or the size of steam condensers 4a, 4b and 4c itself.

Figure 8:
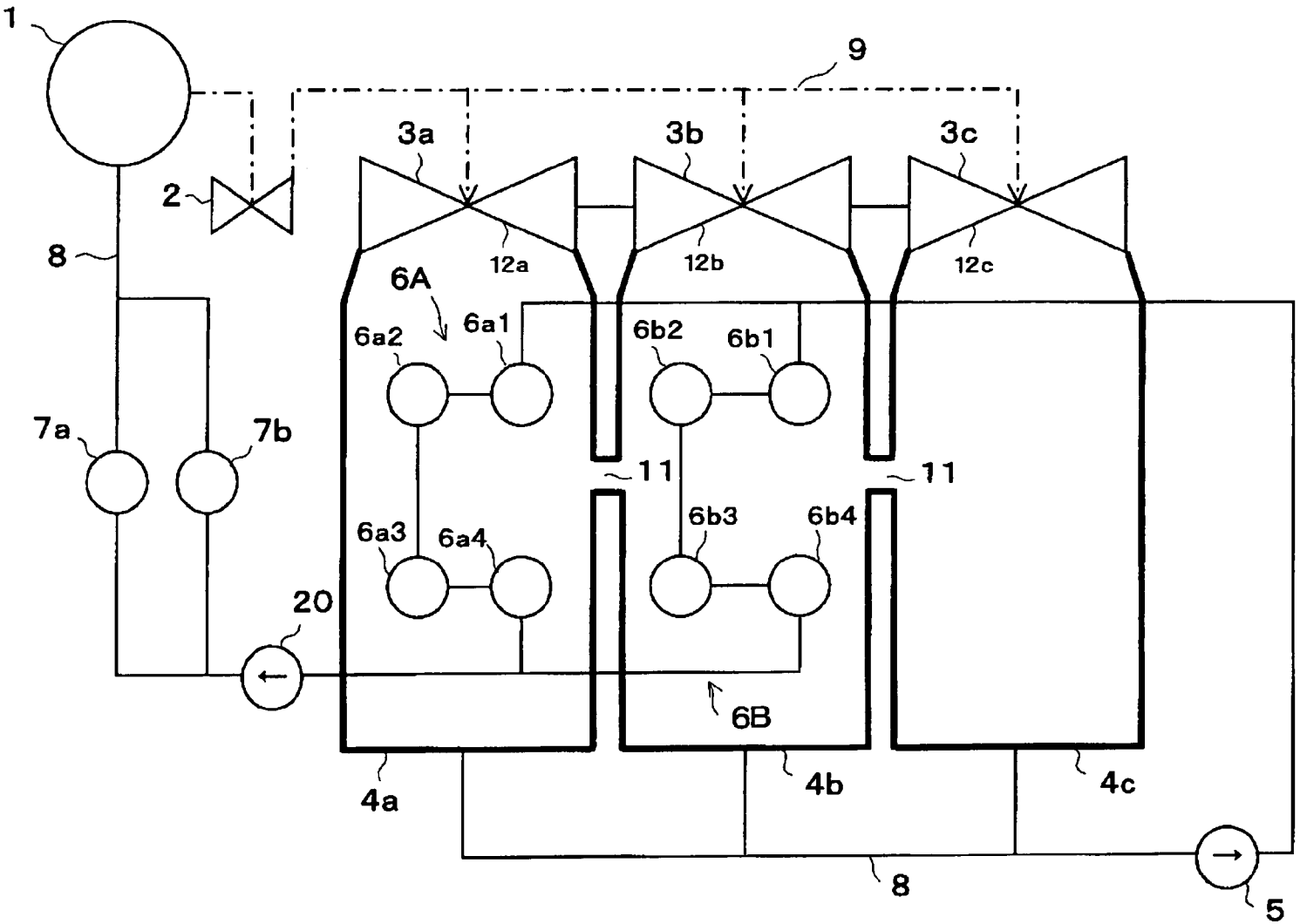

FIG. 8 is another schematic diagram of modified configuration of the first embodiment of a steam turbine plant in accordance with the present invention, including three (3) units of low pressure turbines, casings, and steam condensers, and which especially shows an arrangement of feedwater heaters inside of steam condensers.

The number of the casings of steam turbine 3a, 3b and 3c is also three (3). Each of the casings is connected with each of steam condensers 4a, 4b and 4c respectively. As is the same manner with FIG. 2, feedwater line 8 is divided into two (2) parallel feedwater heating lines 6A and 6B at a downstream side of condensate pump 5 (pressurizer) in feedwater line 8. Low pressure feedwater heaters 6a1 to 6a4 are inserted and connected in series in feedwater heating line 6A, while low pressure feedwater heaters 6b1 to 6b4 are inserted and connected in series in feedwater heating line 6B. Low pressure feedwater heaters 6a1 to 6a4 and 6b1 to 6b4 are neck heaters, which are disposed inside of steam condensers 4a, and 4b.

Steam condenser 4a accommodates low pressure feedwater heaters 6a1, 6a2, 6a3 and 6a4 as neck heaters. Steam condenser 4b accommodates low pressure feedwater heaters 6b1, 6b2, 6b3 and 6b4 as neck heaters. Steam condenser 4c is free of any low pressure feedwater heater 6a1 to 6a4 and 6b1 to 6b4. Feedwater heating lines 6A and 6b are merged into one at an upstream side of high pressure feedwater pump 20 in feedwater line 8.

According to this configuration, total amount of the low pressure feedwater heaters may be also lessened compared to the conventional steam turbine plant. It may contribute to improve pressure drop inside the steam condensers 4a, 4b and 4c, to reduce internal constructions or the size of steam condensers 4a, 4b and 4c itself. Furthermore, an arrangement of low pressure feedwater heaters 6a1 to 6a4 and 6b1 to 6b4 inside of steam condenser 4a and 4b may be substantially the same.

Figure 9:
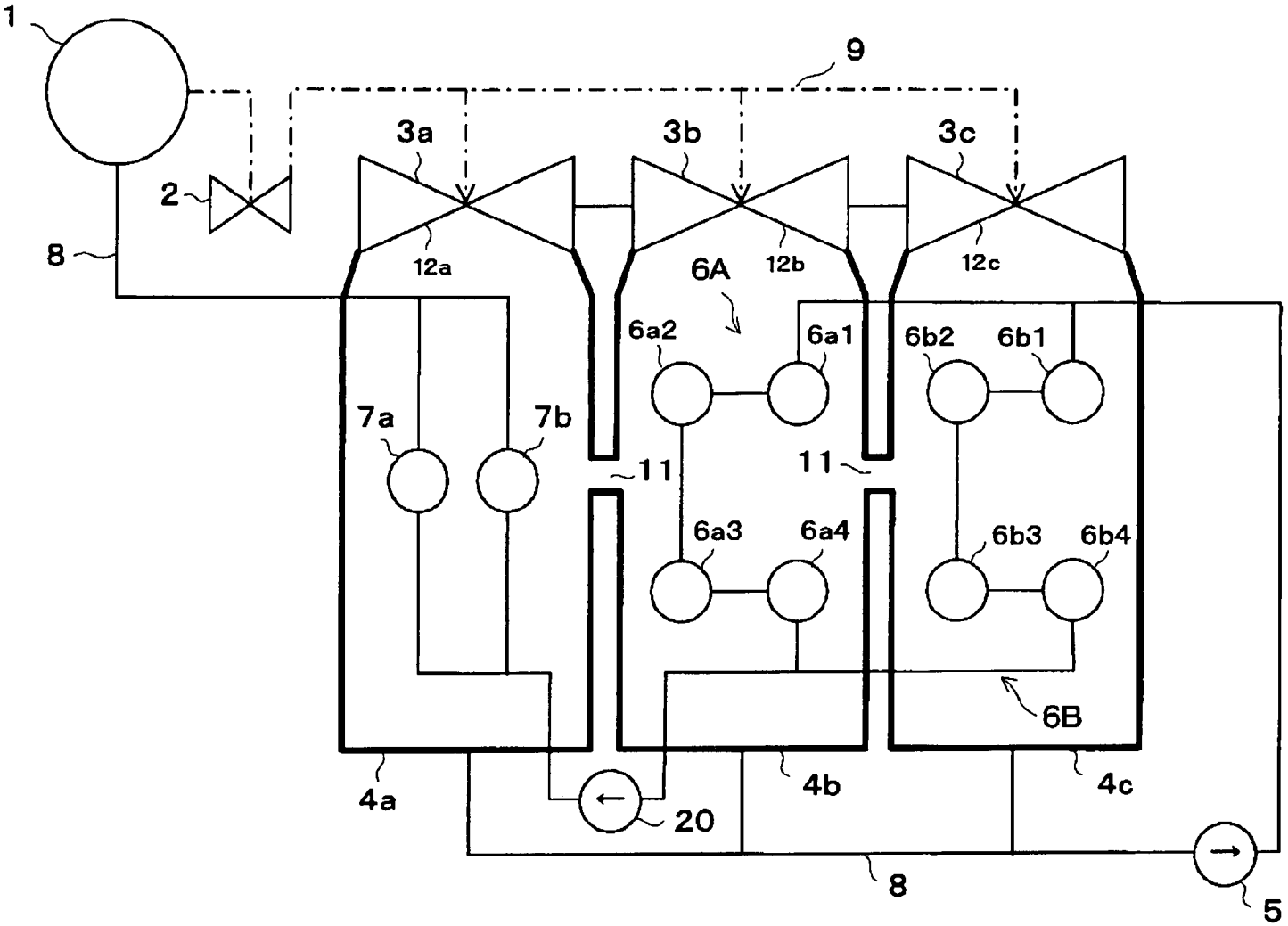

FIG. 9 is another schematic diagram of modified configuration of the first embodiment of a steam turbine plant in accordance with the present invention, including three (3) units of low pressure turbines, casings, and steam condensers, which especially shows an arrangement of feedwater heaters inside of steam condensers.

This configuration is a modification of the configuration shown in FIG. 8. As shown in FIG. 8, steam condenser 4a is free of any low pressure feedwater heater 6a1 to 6a4 and 6b1 to 6b4. Steam condenser 4b accommodates low pressure feedwater heater 6a1, 6a2, 6a3 and 6a4 as neck heaters. Low pressure feedwater heaters 6a1 to 6a4 are inserted and connected in series in feedwater heating line 6A. Steam condenser 4c accommodates low pressure feedwater heater 6b1, 6b2, 6b3 and 6b4 as neck heaters. Low pressure feedwater heaters 6b1 to 6b4 are inserted and connected in series in feedwater heating line 6B. Steam condenser 4a accommodates two (2) high pressure feedwater heater 7a and 7b as neck heaters instead of low pressure feedwater heater 6a1 to 6a4 and 6b1 to 6b4. This configuration may reduce a size of the steam turbine plant itself, since it is not usual for conventional steam turbine plant to arrange high pressure feedwater heaters 7a and 7b inside steam condensers 4a, 4b and 4c as neck heaters. Steam condenser 4a, which is provided with the high pressure feedwater heater may be determined in suitable way. In other words, it may be steam condenser 4b or 4c.

Figure 10:
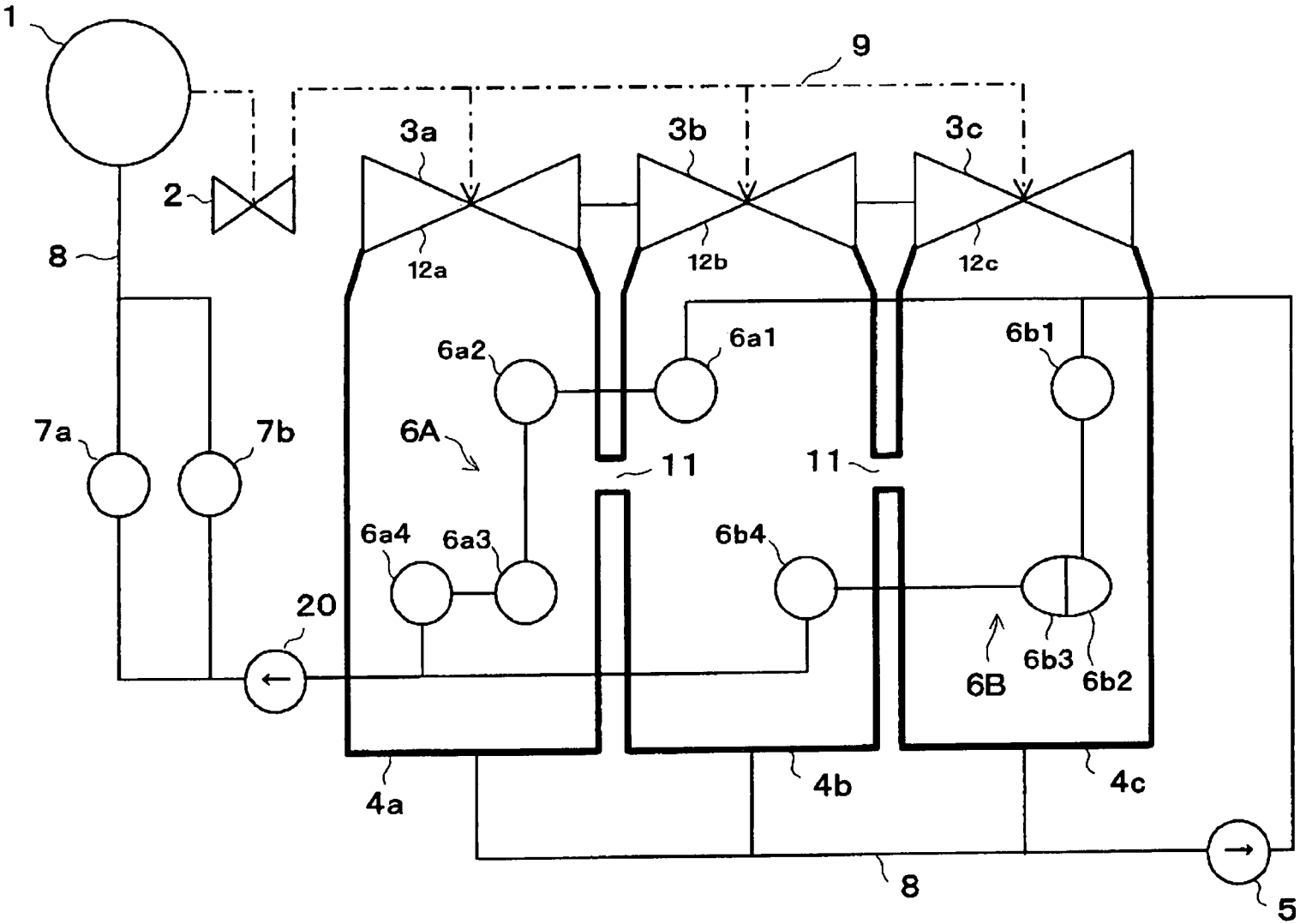

FIG. 10 is another schematic diagram of modified configuration of first embodiment of a steam turbine plant in accordance with the present invention, including three (3) units of low pressure turbines, casings, and steam condensers, which especially shows an arrangement of feedwater heaters inside of steam condensers.

This configuration is a modification of the configuration shown in FIG. 7. As shown in FIG. 7, a dual heater is adopted for low pressure feedwater heaters 6b2 and 6b3, which are connected in series in feedwater heating line 6B. The dual heater, which also has a shell and tube type configuration, is assembled so that two feedwater heaters are combined and form one feedwater heater. The dual heater has a partition inside of the shell. So, the shell of the dual heater is divided in two parts by the partition. Two (2) sets of tubes are installed to each of the parts of the shell.

According to this configuration, the dual heater itself may be larger than a single low pressure feedwater heater, such as low pressure feedwater heater 6b1 or 6b4, still the dual heater is smaller size when compared to two (2) of the low pressure feedwater heaters arranged and connected separately. Therefore, it may improve a space efficiency inside steam condensers 4a, 4b and 4c or it may reduce a size or inner structures of steam condensers 4a, 4b and 4c. And it may also improve the pressure drop inside the steam condensers 4a, 4b and 4c. As the dual heater, two of low pressure feedwater heaters 6a1 to 6a4 and 6b1 to 6b4 may be selected in suitable way. The steam condenser which is provided with the dual heater may also be determined suitably.

Figure 11:
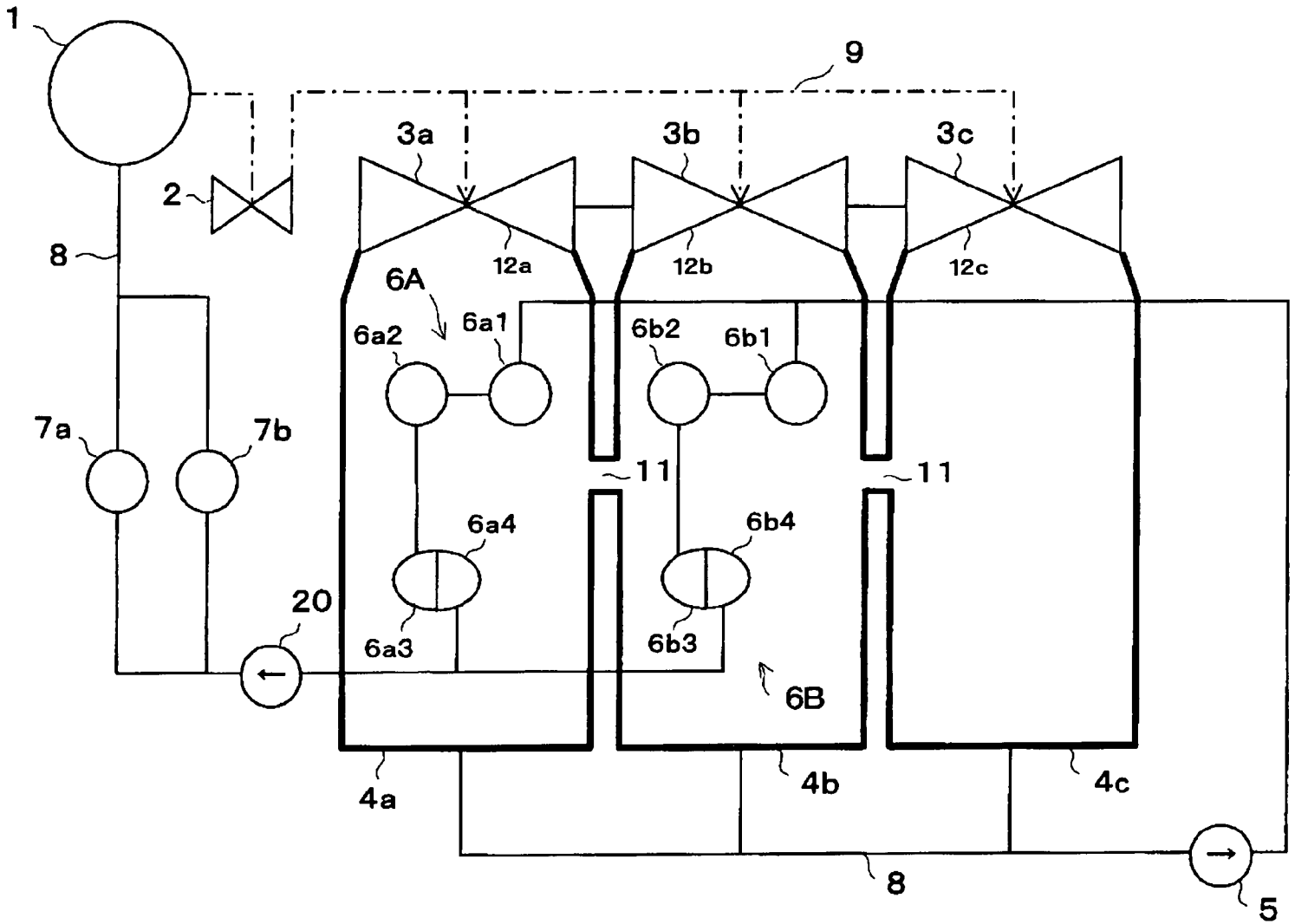

FIG. 11 is another schematic diagram of modified configuration of the first embodiment of a steam turbine plant in accordance with the present invention, including low pressure turbines, casings, and steam condensers of the number of three (3), which especially shows an arrangement of feedwater heaters inside steam condensers.

This configuration is a modification of the example shown in FIG. 8. As shown in FIG. 11, a dual heater is adopted for low pressure feedwater heaters 6a3 and 6a4, which are inserted and connected in series in feedwater heating line 6A. Another dual heater is also adopted for low pressure feedwater heaters 6b3 and 6b4, which are inserted and connected in series in feedwater heating line 6A.

According to configuration, since arrangements of low pressure feedwater heater 6a1 to 6a4 and 6b1 to 6b4 are the same, pressure drop of inside steam condensers 4a and 4b are almost the same. This may improve simplicity of designing the insides of steam condensers 4a and 4b.

Figure 12:
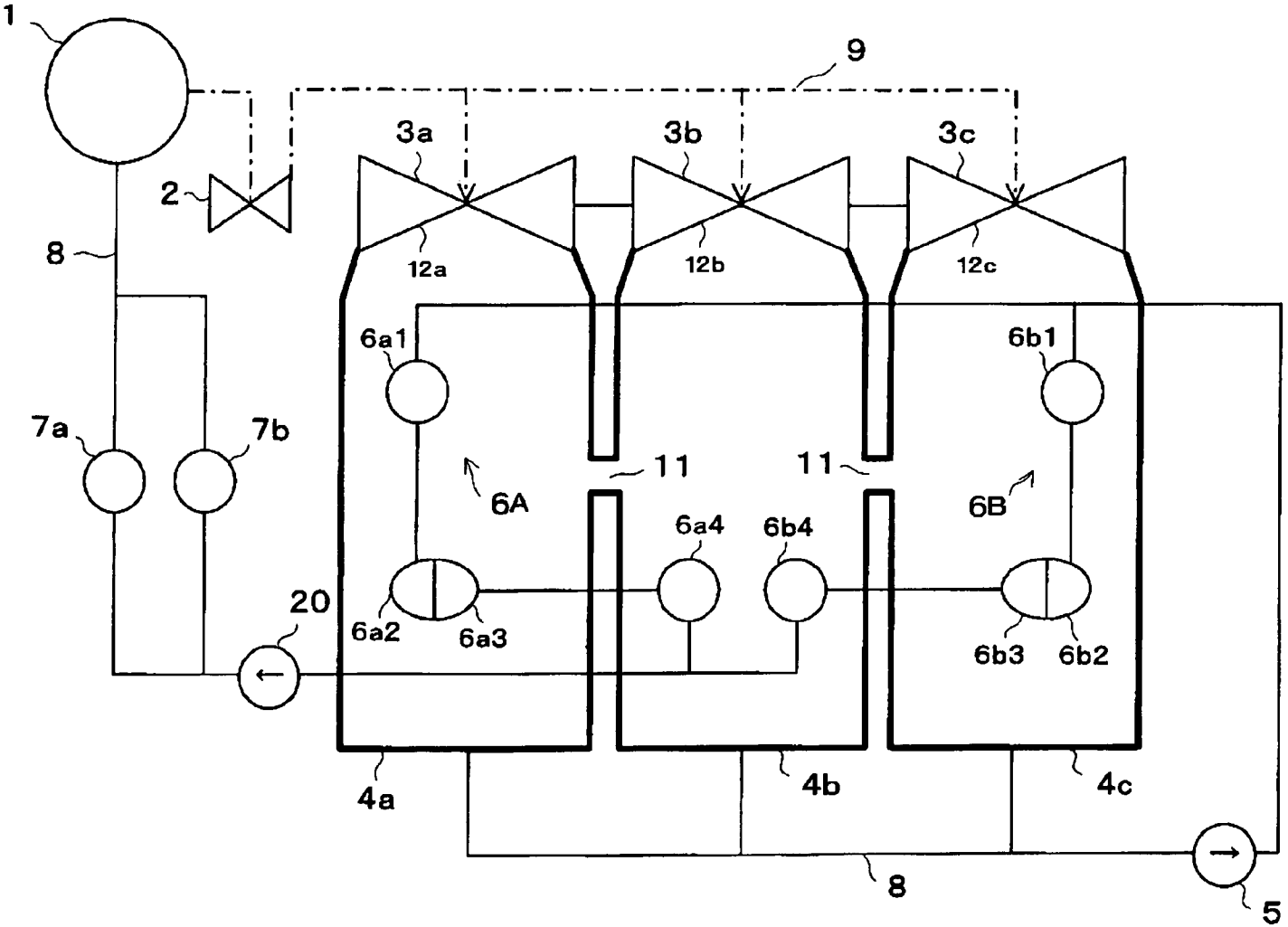

FIG. 12 is another schematic diagram of modified configuration of the first embodiment of a steam turbine plant in accordance with the present invention, including low pressure turbines, casings, and steam condensers of the number of three (3), which especially shows an arrangement of feedwater heaters inside steam condensers.

This configuration is a modification of the configuration shown in FIG. 2. As shown in FIG. 12, a dual heater is adopted for low pressure feedwater heaters 6a2 and 6a3, which are connected in series in feedwater heating line 6A. Another dual heater is also adopted for low pressure feedwater heaters 6b2 and 6b3, which are connected in series in feedwater heating line 6A.

According to configuration, the space efficiency inside of steam condensers 4a, 4b and 4c are improved because of use of the dual heater. Furthermore, since arrangements of low pressure feedwater heater 6a1 to 6a3 and 6b1 to 6b3 may be the same in each of steam condensers 4a and 4c, pressure drop of inside steam condensers 4a and 4c are almost the same. This may improve simplicity of designing inside of steam condensers 4a and 4c.

Figure 13:
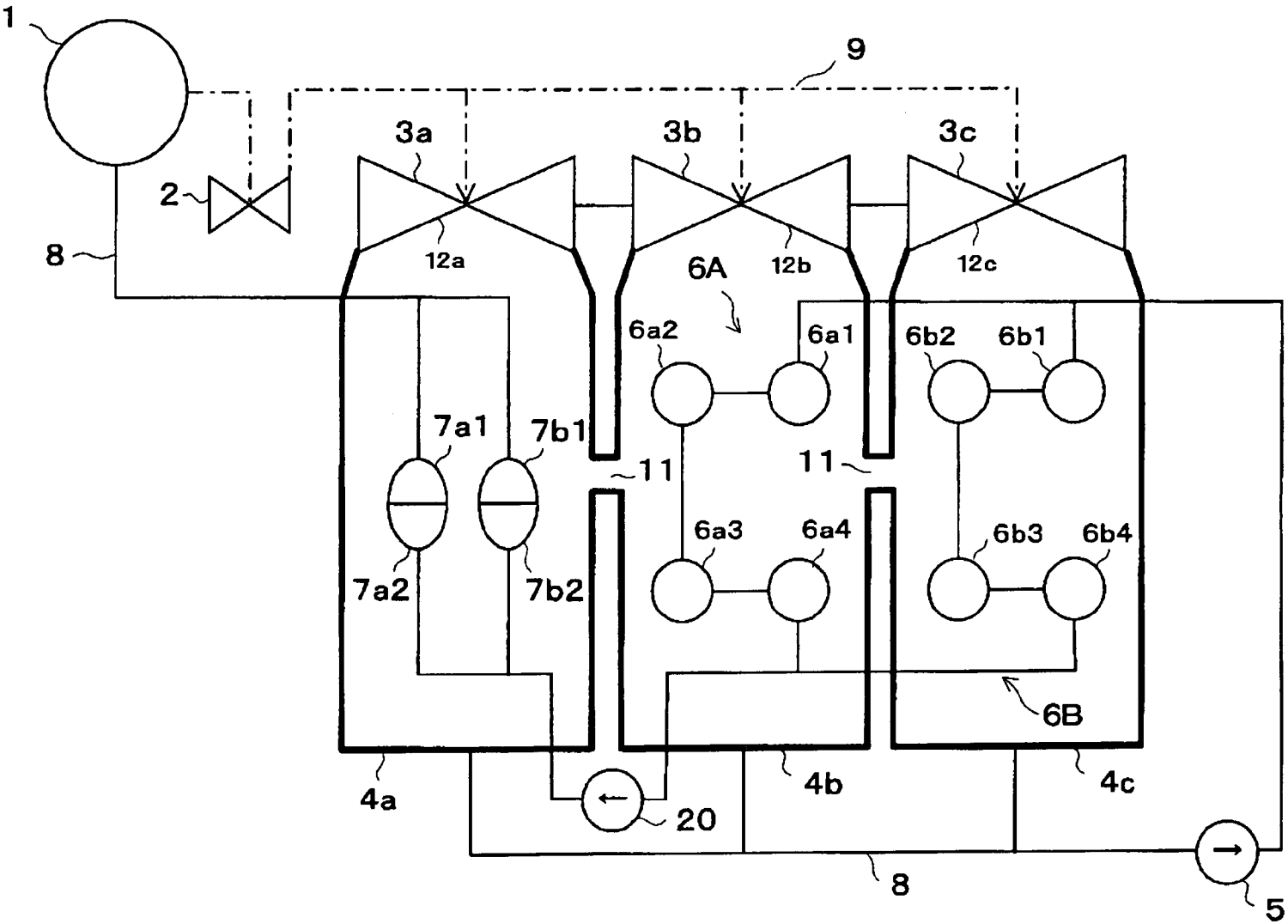

FIG. 13 is another schematic diagram of modified configuration of the first embodiment of a steam turbine plant in accordance with the present invention, including low pressure turbines, casings, and steam condensers of the number of three (3), which especially shows an arrangement of feedwater heaters inside steam condensers.

This configuration is a modification of the example shown in FIG. 9. As shown in FIG. 13, Two (2) lines with two (2) tiers of high pressure feedwater heaters 7a1, 7a2 and 7b1, 7b2 are connected in parallel and are adopted for this configuration. Each two series of feedwater heaters 7a1, 7a2 and 7b1, 7b2 is constructed as the dual heater.

According to this configuration, one of steam condensers 4a, 4b and 4c has high pressure feedwater heaters 7a1, 7a2 and 7b1, 7b2 instead of the low pressure feedwater heaters 6a1 to 6a4 or 6b1 to 6b4. This configuration may reduce a size of the steam turbine plant itself, since it is not usual for a conventional steam turbine plant to arrange high pressure feedwater heaters 7*a* and 7*b* inside steam condensers 4*a*, 4*b* and 4*c* as neck heaters. Steam condenser 4*a*, which is provided with the high pressure feedwater heater may be determined in suitable way. In other words, it may be steam condenser 4*b* or 4*c*.

Second embodiment in accordance with the present invention will be explained with reference to FIG. 13 to FIG. 15.

Figure 14:
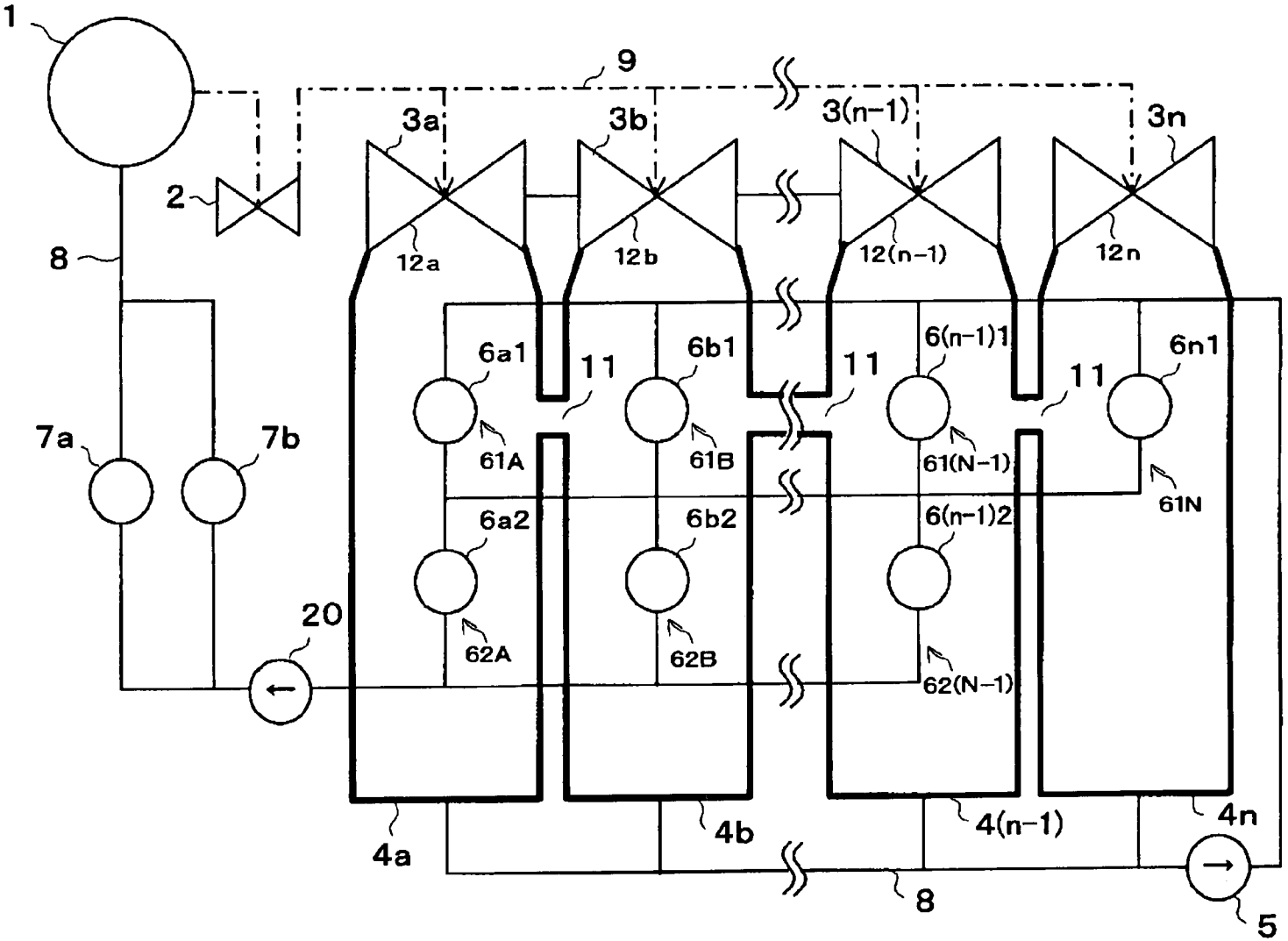
FIG. 14 is a schematic diagram of a second embodiment of a steam turbine plant in accordance with the present invention, which includes n units of pressure turbines, casings, and steam condensers.

FIG. 14 is a schematic diagram of a steam turbine plant in accordance with the present invention, which includes n units of low pressure turbines, n units of casings, and n units of steam condensers.

As is the same manner with the first embodiment shown in FIG. 1, steam generator 1 generates steam. The steam passes through high pressure turbine 2 and steam line 9, then lead to a plurality of casings 12*a*, 12*b*, 12*c*, . . . and 12*n* of low pressure turbines 3*a*, 3*b*, 3*c*, . . . and 3*n*. Each of low pressure turbines 3*a*, 3*b*, 3*c*, . . . and 3*n* are installed in casings 12*a*, 12*b*, 12*c*, . . . and 12*n*, whose number is also the same as the number of low pressure turbines 3*a*, 3*b*, 3*c*, . . . and 3*n*. The steam led to each of the casings 12*a*, 12*b*, 12*c*, . . . and 12*n* drives each of low pressure turbines 3*a*, 3*b*, 3*c*, . . . and 3*n*. The steam is then discharged from low pressure turbines 3*a*, 3*b*, 3*c*, . . . and 3*n* to each of steam condensers 4*a*, 4*b*, 4*c*, . . . and 4*n* as discharged steam. Each of steam condensers 4*a*, 4*b*, 4*c*, . . . and 4*n* are placed beneath each of low pressure turbines 3*a*, 3*b*, 3*c*, . . . and 3*n* and are connected with each of casings 12*a*, 12*b*, 12*c*, . . . and 12*n*. In steam condensers 4*a*, 4*b*, 4*c*, . . . and 4*n*, the discharged steam is cooled down and condenses into water as a condensed water (condensate). The condensed water (condensate) is gathered and led to feedwater line 8. In feedwater line 8, condensate pump 5 (pressurizer) gives pressure to the condensed water (condensate) as a feedwater. The feedwater is led to low pressure feedwater heaters 6*a*1, 6*b*1, 6*c*1, . . . and 6*n*1 and is heated up. The feedwater, after heated up in low pressure feedwater heaters 6*a*1, 6*b*1, 6*c*1, . . . and 6*n*1, is merged and is led to low pressure feedwater heater 6*a*2, 6*b*2, 6*c*2, . . . and 6(*n*-1)2. The feedwater passes through low pressure feedwater heater 6*a*2, 6*b*2, 6*c*2, . . . and 6(*n*-1)2 and is further pumped up by feedwater pump 20 (pressurizer) as high pressure feedwater pump. The feedwater pumped up to high pressure by feedwater pump 20 (pressurizer), then led to high pressure feedwater heaters 7*a* and 7*b* in feedwater line 8. In high pressure feedwater heaters 7*a* and 7*b*, the feedwater is further heated up and then supply to steam generator 1 from feedwater line 8. In this manner, the steam turbine plant constitutes closed-loop as a Rankine Cycle.

Bled steam for low pressure feedwater heaters 6*a*1, 6*b*1, 6*c*1, . . . 6*n*1 and 6*a*2, 6*b*2, 6*c*2, . . . 6(*n*-1)2 is taken out from the middle of low pressure turbines 3*a*, 3*b*, 3*c*, . . . and 3*n* as the same manner with the first embodiment. The bled steam is led to the bleeding lines (not shown) and is supplied to low pressure feedwater heaters 6*a*1, 6*b*1, 6*c*1, . . . 6*n*1 and 6*a*2, 6*b*2, 6*c*2, . . . 6(*n*-1)2.

Low pressure feedwater heaters 6*a*1, 6*b*1, 6*c*1, . . . 6*n*1 and 6*a*2, 6*b*2, 6*c*2, . . . 6(*n*-1)2 are installed inside of neck portions of steam condensers 4*a*, 4*b*, 4*c*, . . . and 4*n* to improve a space efficiency.

Steam condensers 4*a*, 4*b*, 4*c*, and 4*n* are closely arranged each other. N units of low pressure feedwater heaters 6*a*1, 6*b*1, 6*c*1, . . . and 6*n*1 are provided inside steam condensers 4*a*, 4*b*, 4*c*, . . . and 4*n*. (n-1) units of low pressure feedwater heaters 6*a*2, 6*b*2, 6*c*2, . . . and 6(*n*-1)2 are provided inside steam condensers 4*a*, 4*b*, 4*c*, . . . and 4(*n*-1). Feedwater line 8 includes a plurality of first feed water heating lines 61A, 61B, 61C, . . . and 61N. Each of first feed water heating lines 61A, 61B, 61C, . . . and 61N has one of low pressure feedwater heaters 6*a*1, 6*b*1, 6*c*1, . . . 6*n*1 respectively. Low pressure feedwater heaters 6*a*1, 6*b*1, 6*c*1, . . . 6*n*1 are arranged and connected in parallel inside of steam condensers 4*a*, 4*b*, 4*c*, . . . and 4*n*. First feedwater heating lines 61A, 61B, 61C, . . . and 61N are provided between condensate pump 5 (pressurizer) and high pressure feedwater pump 20 (pressurizer) in feedwater line 8.

Feedwater line 8 further includes a plurality of second feed water heating lines 62A, 62B, 62C, . . . and 62(N-1) at a downstream side of first feedwater heating lines 61A, 61B, 61C, . . . and 61N. Each of second feed water heating lines 62A, 62B, 62C, . . . and 62(N-1) has one of low pressure feedwater heaters 6*a*2, 6*b*2, 6*c*2, . . . 6(*n*-1)2 respectively. Low pressure feedwater heaters 6*a*2, 6*b*2, 6*c*2, . . . 6(*n*-1)2 are arranged and connected in parallel inside of steam condensers 4*a*, 4*b*, 4*c*, and 4(*n*-1). Second feedwater heating lines 62A, 62B, 62C, . . . and 62(N-1) are connected in parallel and inserted in series at a downstream side of first feedwater heating lines 61A, 61B, 61C, . . . and 61N in feedwater line 8.

Thus, feedwater lines 8 includes first feed water heating lines 61A, 61B, 61C, . . . and 61N and second feed water heating lines 62A, 62B, 62C, . . . and 62(N-1) as a constituent elements. First feedwater heating lines 61A, 61B, 61C and 61N as a whole are seriesly inserted in feedwater line 8. Second feedwater heating lines 62A, 62B, 62C, . . . and 62(N-1), whose number is less than the number of first feedwater heating lines 61A, 61B, 61C, . . . and 61N, are coupled to a downstream side of first feedwater heating lines 61A, 61B, 61C, . . . and 61N and are seriesly inserted in feedwater line 8 as a whole.

Each of second feedwater heating lines 62A, 62B, 62C, . . . and 62(N-1) may have a plurality of low pressure feedwater heaters arranged and connected in series. In this case, all of steam condensers 4*a*, 4*b*, 4*c*, . . . and 4*n* may have at least one of low pressure feedwater heaters, and the number of the low pressure feedwater heaters may be greater than the number of steam condensers 4*a*, 4*b*, 4*c*, . . . and 4*n*. Still there is a less number of the second feedwater heating lines than the number of steam condensers 4*a*, 4*b*, 4*c*, . . . and 4*n*. The number of the feedwater heating lines may be one (1) or more, but is less than the number of steam condensers 4*a*, 4*b*, 4*c*, . . . and 4*n*. The bleeding steam lines may be connected to any of casings 12*a*, 12*b*, 12*c*, and 12*n* of low pressure turbines 3*a*, 3*b*, 3*c*, . . . and 3*n* as the same manner with the first embodiment.

According to this embodiment, the number of the low pressure feedwater heaters disposed inside of steam condenser 4*a*, 4*b*, 4*c*, . . . and 4*n* are lessened compared with a conventional steam turbine plant. In order to keep the amount of heat exchanged in the low pressure feedwater heaters at a preferable level, each of low pressure feedwater heaters 6*a*, 6*b*, 6*c*, . . . and 6(*n*-1) may be enlarged in size to increase the amount of heat. However, internal structures, such as the bleeding lines, of steam condensers 4*a*, 4*b*, 4*c*, . . . and 4*n* may be lessened to improve pressure drop of the steam inside steam condensers 4*a*, 4*b*, 4*c*, . . . and 4*n*. And the size of steam condensers 4*a*, 4*b*, 4*c*, . . . and 4*n* may be reduced.

Some detailed configurations of the second embodiment having three (3) units of the low pressure turbines, the casings and the steam condensers are explained below with reference of FIGS. 15 and 16.

Figure 15:
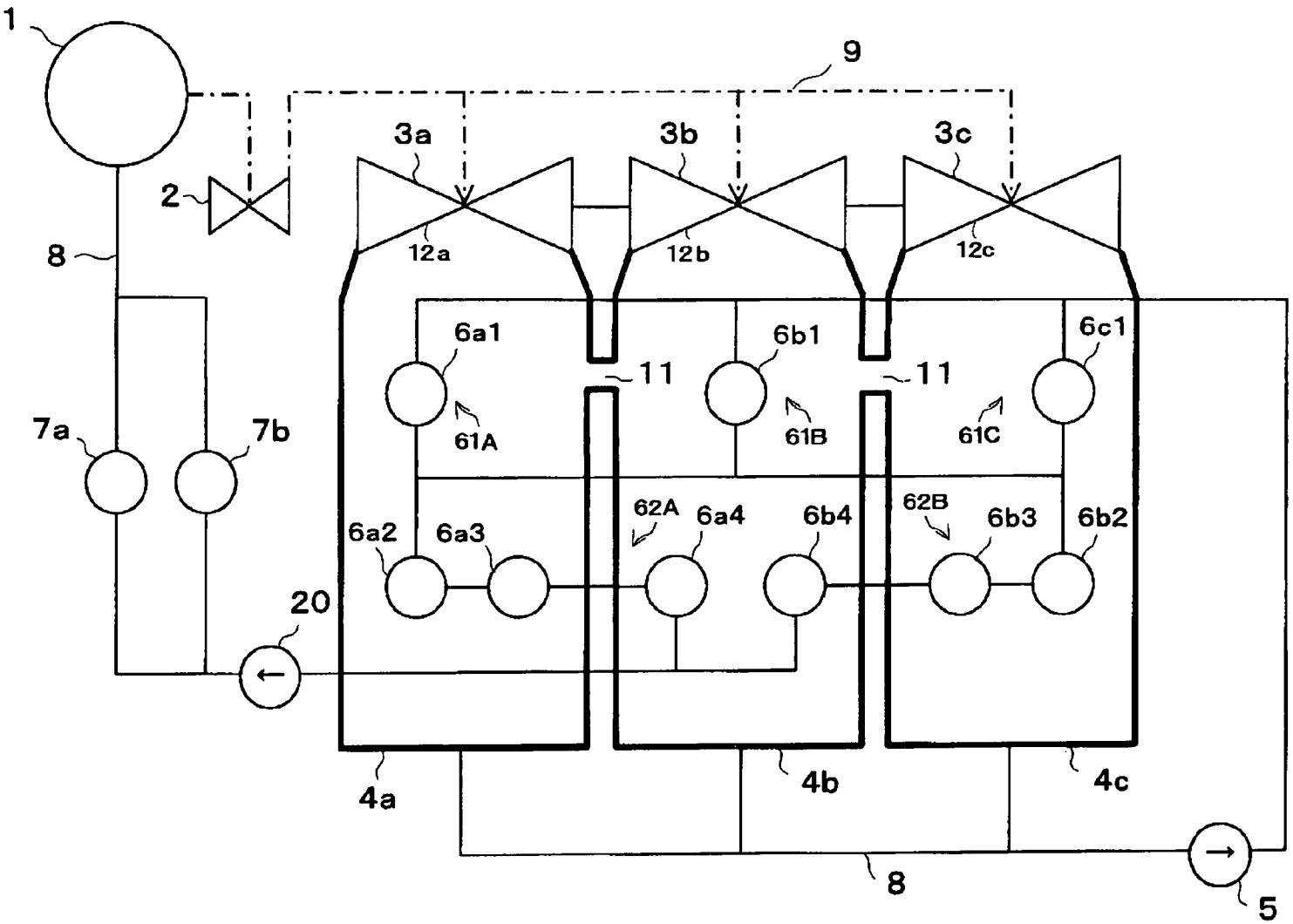
FIGS. 15 and 16 are schematic diagrams of a second embodiment of a steam turbine plant in accordance with the present invention, which includes three (3) units of low pressure turbines, casings, and steam condensers, especially showing an arrangement of feedwater heaters inside steam condensers.
Figure 16:
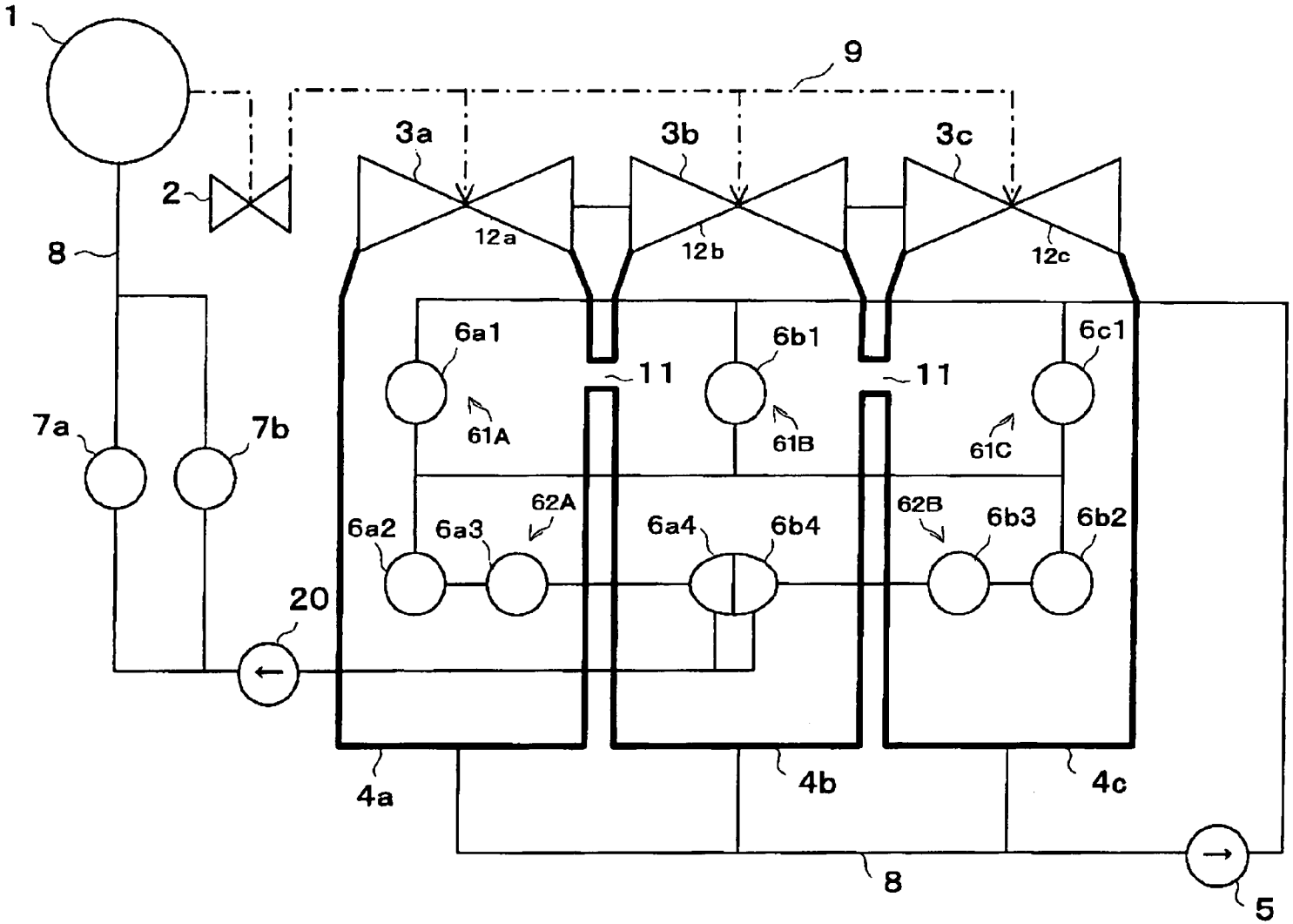

FIGS. 15 and 16 are schematic diagrams of a detailed configuration of the first embodiment of a steam turbine plant in accordance with the present invention, including three (3) units of low pressure turbines, three (3) units of casings, and three (3) units of steam condensers.

FIG. 14 especially features an arrangement of feedwater heaters inside steam condensers. The number of the casings 12*a*, 12*b* and 12*c* of steam turbine 3*a*, 3*b* and 3*c* is three (3). Each of the casings 12*a*, 12*b* and 12*c* is connected with each of steam condensers 4*a*, 4*b* and 4*c* respectively.

As described in FIG. 15, feedwater line 8 is divided into three (3) of first feedwater heating lines 61A, 61B and 61C at a downstream side of condensate pump 5 (pressurizer). Feedwater line 8 is further divided at a downstream side of first feedwater heating lines 61A, 61B and 61C into two (2) second feedwater heating lines 62A and 62B.

Low pressure feedwater heaters 6*a*1, 6*b*1 and 6*c*1 are connected in series in each of first feedwater heating lines 6A, 6B and 6C respectively. Low pressure feedwater heater 6*a*2 to 6*a*4 are connected in series in second feedwater heating line 62A, while low pressure feedwater heaters 6*b*2 to 6*b*4 are connected in series in second feedwater heating line 62B. Low pressure feedwater heaters 6*a*1 to 6*a*4 and 6*b*1 to 6*b*4 are neck heaters, which are disposed inside of steam condensers 4*a*, 4*b* and 4*c*. Each three (3) of low pressure feedwater heaters 6*a*2 to 6*a*4 and 6*b*2 to 6*b*4, which are connected in series in either of second feedwater heating lines 62A or 62B, are dispersed in two (2) of steam condensers 4*a*, 4*b* and 4*c*.

Steam condenser 4*a* accommodates low pressure feedwater heaters 6*a*1, 6*a*2 and 6*a*3 as neck heaters. Steam condenser 4*b* accommodates low pressure feedwater heaters 6*a*4, 6*b*1 and 6*b*4 as neck heaters. Steam condenser 4*c* accommodates low pressure feedwater heaters 6*c*1, 6*b*2 and 6*b*3 as neck heaters. Feedwater heating lines 6A and 6*b* are merged into one at an upstream side of high pressure feedwater pump 20 in feedwater line 8.

The feedwater, from first feedwater heating lines 61A, 61B and 61C, is divided into two flows and is led to each of feedwater heating lines 62A and 62B. In feedwater heating line 62A, The temperature of the feedwater rises as the feedwater flow through low pressure feedwater heaters 6*a*2, 6*a*3 and 6*a*4 in this order. In the same manner, the temperature of the feedwater rises as the feedwater flows through low pressure feedwater heaters 6*b*2, 6*b*3 and 6*b*4 in this order in feedwater heating line 62B. As a heating source, steam bled from low pressure steam turbine 3*a*, 3*b* and 3*c* may be introduced to low pressure feedwater heater 6*a*1 to 6*a*4 and 6*b*1 to 6*b*4 as the same manner shown in FIGS. 3 to 7.

FIG. 16 is other schematic diagram of modified configuration of the second embodiment of a steam turbine plant in accordance with the present invention, including low pressure turbines, casings, and steam condensers of the number of three (3), which especially shows an arrangement of feedwater heaters inside steam condensers.

This configuration is a modification of the configuration shown in FIG. 15. As shown in FIG. 16, a dual heater is adopted for low pressure feedwater heaters 6*a*4 and 6*b*4, which are connected in series in each of second feedwater heating line 62A or 62B respectively.

According to this configuration, the space efficiency inside of steam condensers 4*a*, 4*b* and 4*c* are improved because of use of the dual heater. Furthermore, since arrangements of low pressure feedwater heater 6*a*1 to 6*a*3 and 6*b*1 to 6*b*3 may be the same in each of steam condensers 4*a* and 4*c*, pressure drop of inside steam condensers 4*a* and 4*c* are almost the same. This may improve simplicity of designing the insides of steam condensers 4*a* and 4*c*.

Other embodiments of the present invention will be apparent to those skilled in the art from consideration of the specification and practice of the invention disclosed herein. It is intended that the specification and example embodiments be considered as exemplary only, with a true scope and spirit of the invention being indicated by the following.

What is claimed is:

1. A steam turbine plant, comprising:

a steam generator;

a plurality of low pressure turbines being driven by steam from the steam generator;

a plurality of steam condensers to condense the steam from the low pressure turbines into condensed water;

a feedwater line which supplies the condensed water to the steam generator as feedwater, the feedwater line including a plurality of feedwater heating lines connected in parallel, a number of feedwater heating lines being less than a number of steam condensers; and a plurality of low pressure feedwater heaters;

wherein each of the feedwater heating lines includes at least one low pressure feedwater heater provided in at least one of the steam condensers to heat the condensed water by steam bled from the low pressure turbines.

2. A steam turbine plant according to claim 1, wherein at least one of the feedwater heating lines includes a plurality of low pressure feedwater heaters connected in series, and wherein a first number of low pressure feedwater heaters provided in a first steam condenser is different than a second number of low pressure feedwater heaters provided in a second steam condenser.

3. A steam turbine plant according to claim 1, wherein the steam condensers include at least a first steam condenser and a second steam condenser;

wherein at least one of the feedwater heating lines includes at least a first low pressure feedwater heater and a second low pressure feedwater heater connected in series; and wherein the first low pressure feedwater heater is provided in the first steam condenser and the second low pressure feedwater heater is provided in the second steam condenser.

4. A steam turbine plant according to claim 1, wherein each of the steam condensers is provided with at least one of the low pressure feedwater heaters.

5. A steam turbine plant according to claim 1, further comprising:

a high pressure turbine provided at an upstream side of the low pressure turbines and being driven by the steam from the steam generator;

a high pressure feedwater pump which provides pressure to the feedwater from the low pressure feedwater heaters; and a high pressure feedwater heater provided in at least one of the steam condensers to heat the feedwater by steam bled from the high pressure turbine.

6. A steam turbine plant according to claim 1, further comprising:

a plurality of casings, a respective casing for each of the low pressure turbines;

wherein each of the casings is provided with a bleeding opening, a position of the bleeding opening being substantially the same for each of the casings.

7. A steam turbine plant according to claim 1, further comprising:

a plurality of casings, a respective casing for each of the low pressure turbines;

wherein each of the casings is connected to a bleeding line; and wherein, for each casing, the respective bleeding line is connected to at least one of the low pressure feedwater heaters provided in the steam condensers connected with that casing.

8. A steam turbine plant according to claim 1, wherein at least one of the steam condensers is free of any low pressure feedwater heaters.

9. A steam turbine plant according to claim 1, wherein an output of a low pressure feedwater heater in a first steam condenser leads to a low pressure feedwater heater in a second steam condenser.

10. A steam turbine plant according to claim 1, further comprising:

a plurality of casings, a respective casing for each of the low pressure turbines;

wherein each of the casings is provided with a bleeding opening; and a bleeding line is provided between a bleeding opening of a casing connected to a first steam condenser and a low pressure feedwater heater provided in a second steam condenser.

11. A steam turbine plant according to claim 10, wherein the first and second steam condensers are connected by a connection shell.

12. A steam turbine plant according to claim 1, further comprising:

a plurality of steam bleeding lines connected to the low pressure steam turbines;

a bleeding steam header connected with at least one of the steam bleeding lines; and a bleeding steam supply line provided between the bleeding steam header and at least one of the low pressure feedwater heater.

13. A steam turbine plant according to claim 12, wherein the bleeding steam header is provided inside of the steam condensers.

14. A steam turbine plant according to claim 12, wherein the bleeding steam header is provided outside of the steam condensers.

15. A steam turbine plant, comprising:

a steam generator;

a plurality of low pressure turbines being driven by steam from the steam generator;

a plurality of steam condensers to condense the steam from the low pressure turbines into condensed water;

a feedwater line which supplies the condensed water to the steam generator as feedwater, the feedwater line including a plurality of first feedwater heating lines connected in parallel and a plurality of second feedwater heating lines connected in parallel and coupled to the downstream side of the first feedwater heating lines, a first number of first feedwater heating lines being different than a second number of second feedwater heating lines; and a plurality of low pressure feedwater heaters;

wherein each of the first and second feedwater heating lines includes at least one low pressure feedwater heater provided in at least one of the steam condensers to heat the condensed water by steam bled from the low pressure turbines.

16. A steam turbine plant according to claim 15, wherein at least one of the first and second feedwater heating lines includes a plurality of low pressure feedwater heaters connected in series, and wherein a first number of low pressure feedwater heaters provided in a first steam condenser is different than a second number of low pressure feedwater heaters provided in a second steam condenser.

17. A steam turbine plant according to claim 15, wherein the steam condensers include at least a first steam condenser and a second steam condenser;

wherein at least one of the first and second feedwater heating lines includes at least a first low pressure feedwater heater and a second low pressure feedwater heater connected in series; and wherein the first low pressure feedwater heater is provided in the first steam condenser and the second low pressure feedwater heater is provided in the second steam condenser.

18. A steam turbine plant according to claim 15, further comprising:

a plurality of casings, a respective casing for each of the low pressure turbines;

wherein each of the casings is provided with a bleeding opening, a position of the bleeding opening being substantially the same for each of the casings.

19. A steam turbine plant according to claim 15, further comprising:

a plurality of casings, a respective casing for each of the low pressure turbines;

wherein each of the casings is connected to a bleeding line; and wherein, for each casing, the respective bleeding line is connected to at least one of the low pressure feedwater heaters provided in the steam condensers connected with that casing.

20. A steam turbine plant according to claim 15, wherein an output of a low pressure feedwater heater in a first steam condenser leads to a low pressure feedwater heater in a second steam condenser.

21. A steam turbine plant according to claim 15, further comprising:

a plurality of casings, a respective casing for each of the low pressure turbines;

wherein each of the casings is provided with a bleeding opening; and a bleeding line is provided between a bleeding opening of a casing connected to a first steam condenser and a low pressure feedwater heater provided in a second steam condenser.

22. A steam turbine plant according to claim 21, wherein the first and second steam condensers are connected by a connection shell.

23. A steam turbine plant according to claim 15, wherein the first number of first feedwater heating lines is equal to the number of steam condensers.

24. A steam turbine plant according to claim 23, wherein the first number of first feedwater heating lines is greater than the second number of second feedwater heating lines.

25. A steam turbine plant according to claim 15, further comprising:

a plurality of steam bleeding lines connected to the low pressure steam turbines;

a bleeding steam header connected with at least one of the steam bleeding lines; and a bleeding steam supply line provided between the bleeding steam header and at least one of the low pressure feedwater heaters.

26. A steam turbine plant according to claim 25, wherein the bleeding steam header is provided inside of the steam condensers.

27. A steam turbine plant according to claim 25, wherein the bleeding steam header is provided outside of the steam condensers.

28. A steam turbine plant, comprising:

a steam generator;

a plurality of low pressure turbines being driven by steam from the steam generator;

a plurality of steam condensers to condense the steam from the low pressure turbines into condensed water;

a feedwater line which supplies the condensed water to the steam generator as feedwater, the feedwater line including a plurality of feedwater heating lines connected in parallel; and a plurality of low pressure feedwater heaters;

wherein each of the feedwater heating lines includes at least one low pressure feedwater heater provided in at least one of the steam condensers to heat the condensed water by steam bled from the low pressure turbines, and wherein a first number of low pressure feedwater heaters provided in a first steam condenser is different than a second number of low pressure feedwater heaters provided in a second steam condenser.

29. A steam turbine plant according to claim 28, wherein at least one of the feedwater heating lines includes a plurality of low pressure feedwater heaters connected in series.

30. A steam turbine plant according to claim 28, wherein at least one of the feedwater heating lines includes at least a first low pressure feedwater heater and a second low pressure feedwater heater connected in series; and wherein the first low pressure feedwater heater is provided in the first steam condenser and the second low pressure feedwater heater is provided in the second steam condenser.

31. A steam turbine plant according to claim 28, wherein each of the steam condensers is provided with at least one of the low pressure feedwater heaters.

32. A steam turbine plant according to claim 28, further comprising:

a high pressure turbine provided at an upstream side of the low pressure turbines and driven by the steam from the steam generator;

a high pressure steam bleeding line connected to the high pressure turbine;

a high pressure feedwater pump which provides pressure to the feedwater from the feedwater line; and a high pressure feedwater heater provided in at least one of the steam condensers to heat the feedwater by steam bled from the high pressure steam bleeding line.

33. A steam turbine plant according to claim 28, further comprising:

a plurality of casings, a respective casing for each of the low pressure turbines;

wherein each of the casings is provided with a bleeding opening, a position of the bleeding opening being substantially the same for each of the casings.

34. A steam turbine plant according to claim 28, further comprising:

a plurality of casings, a respective casing for each of the low pressure turbines;

wherein each of the casings is connected to a bleeding line; and wherein, for each casing, the respective bleeding line is connected to at least one of the low pressure feedwater heaters provided in the steam condensers connected with that casing.

35. A steam turbine plant according to claim 28, wherein at least one of the steam condensers is free of any low pressure feedwater heaters.

36. A steam turbine plant according to claim 28, wherein an output of a low pressure feedwater heater in a first steam condenser leads to a low pressure feedwater heater in a second steam condenser.

37. A steam turbine plant according to claim 28, further comprising:

a plurality of casings, a respective casing for each of the low pressure turbines;

wherein each of the casings is provided with a bleeding opening; and a bleeding line is provided between a bleeding opening of a casing connected to the first steam condenser and a low pressure feedwater heater provided in the second steam condenser.

38. A steam turbine plant according to claim 37, wherein the first and second steam condensers are connected by a connection shell.

39. A steam turbine plant according to claim 28, further comprising:

a plurality of steam bleeding lines connected to the low pressure steam turbines;

a bleeding steam header connected with at least one of the steam bleeding lines; and a bleeding steam supply line provided between the bleeding steam header and at least one of the low pressure feedwater heaters.

40. A steam turbine plant according to claim 39, wherein the bleeding steam header is provided inside of the steam condensers.

41. A steam turbine plant according to claim 39, wherein the bleeding steam header is provided outside of the steam condensers.

* * * * *